US007704659B2

(12) United States Patent
Ogawa et al.

(10) Patent No.: US 7,704,659 B2
(45) Date of Patent: Apr. 27, 2010

(54) TONER

(75) Inventors: Yoshihiro Ogawa, Yokohama (JP); Yusuke Hasegawa, Suntou-gun (JP); Kouji Nishikawa, Suntou-gun (JP); Miho Okazaki, Suntou-gun (JP); Takashige Kasuya, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/420,336

(22) Filed: Apr. 8, 2009

(65) Prior Publication Data

US 2009/0197193 A1 Aug. 6, 2009

Related U.S. Application Data

(63) Continuation of application No. PCT/JP2008/073926, filed on Dec. 25, 2008.

(30) Foreign Application Priority Data

Dec. 27, 2007 (JP) ..... 2007-335930

(51) Int. Cl.
*G03G 9/08* (2006.01)

(52) U.S. Cl. ..... 430/108.1; 430/108.8

(58) Field of Classification Search ..... 430/108.4, 430/108.22, 111.4, 108.1, 108.8
See application file for complete search history.

(56) References Cited

U.S. PATENT DOCUMENTS

| | | | | |
|---|---|---|---|---|
| 4,859,550 | A | 8/1989 | Gruber et al. | 430/39 |
| 4,883,736 | A | 11/1989 | Hoffend et al. | 430/110 |
| 5,300,386 | A | 4/1994 | Kanbayashi et al. | 430/99 |
| 5,478,686 | A | 12/1995 | Kawakami et al. | 430/106.6 |
| 5,840,457 | A | 11/1998 | Urawa et al. | 430/45 |
| 6,485,875 | B1 * | 11/2002 | Karaki et al. | 430/108.23 |
| 7,306,889 | B2 | 12/2007 | Okubo et al. | 430/137.15 |
| 7,351,509 | B2 | 4/2008 | Moribe et al. | 430/108.8 |
| 2002/0034702 | A1 * | 3/2002 | Onuma et al. | 430/108.4 |
| 2008/0014522 | A1 | 1/2008 | Okubo et al. | 430/109.3 |

FOREIGN PATENT DOCUMENTS

| | | |
|---|---|---|
| JP | 63-113558 | 5/1988 |
| JP | 04-097163 | 3/1992 |
| JP | 04-197162 | 7/1992 |
| JP | 2000-267347 | 9/2000 |
| JP | 2001-343781 | 12/2001 |
| JP | 2002-055477 | 2/2002 |
| JP | 2004-004737 | 1/2004 |
| JP | 2004-247708 | 12/2004 |

* cited by examiner

*Primary Examiner*—John L Goodrow
(74) *Attorney, Agent, or Firm*—Fitzpatrick, Cella, Harper & Scinto

(57) ABSTRACT

To provide a toner which has superior low-temperature fixing performance, high-temperature anti-offsetting properties and developing performance and may cause neither melt sticking of toner to photosensitive member nor turn-up of cleaning blade. The toner contains at least a binder resin, a colorant and a wax, and the wax is characterized by i) being an oxidized hydrocarbon wax, ii) having a hydroxyl value of from 5 mgKOH/g or more to 150 mgKOH/g or less, and iii) having, in molecular weight distribution measured by gel permeation chromatography of tetrahydrofuran-soluble matter, a main peak within the range of molecular weight of from 200 or more to 600 or less, and a component with a molecular weight of 700 or more in a content of 3% by mass or less.

3 Claims, No Drawings

TONER

This application is a continuation of International Application No. PCT/JP2008/073926, filed Dec. 25, 2008, which claims the benefit of Japanese Patent Application No. 2007-335930, filed Dec. 27, 2007.

BACKGROUND OF THE INVENTION

1. Field of the Invention

This invention relates to a toner used in image forming processes such as electrophotography, electrostatic printing and toner jet recording.

2. Related Background Art

Conventionally, it is known to incorporate a toner with an alcohol component in order to improve low-temperature fixing performance and high-temperature anti-offsetting properties of the toner.

Japanese Patent Laid-open Applications Nos. S63-113558, S63-188158, H02-134648, H04-097162, H04-097163 and so forth discloses techniques in which toners are incorporated with alcohol components.

Incorporation of toners with waxes having such alcohol components may bring out the effect of improving low-temperature fixing performance and high-temperature anti-offsetting properties of the toners, but, when used in a severe environment such as a high-temperature and high-humidity environment over a long period of time, tends to accelerate deterioration of toners to make their developing performance poor in some cases.

Japanese Patent Laid-open Application No. 2001-343781 also discloses a toner containing a hydrocarbon wax having a hydroxyl value (HV) of 5 to 150 mgKOH/g, an ester value (EV) of 1 to 50 mgKOH/g and HV>EV.

Japanese Patent Laid-open Application No. 2000-267347 further discloses a wax for electrophotographic toners which is an alcohol type wax having a hydroxyl value of 50 to 90 mgKOH/g, obtained by subjecting any of a petroleum wax, an $\alpha$-olefin wax having a double bond at its terminal and Fischer-Tropsch wax to air oxidation in the presence of boric acid.

Incorporation of toners with such waxes having a hydroxyl group enables improvement in low-temperature fixing performance and high-temperature anti-offsetting properties and also achievement of superior developing performance. However, in a situation where the internal temperature of a copying machine or printer has come higher as in the case of double-side printing performed continuously in a high-temperature environment, the toner may melt-stick to a photosensitive member to cause image defects such as white dots or a cleaning blade coming into contact with the photosensitive member may turn up to cause faulty cleaning. In order to resolve such problems, it is necessary to lessen the content of the wax having a hydroxyl group, and this makes the toner less effectively improved in low-temperature fixing performance and high-temperature anti-offsetting properties.

SUMMARY OF THE INVENTION

The present invention aims to provide a toner which has superior low-temperature fixing performance, high-temperature anti-offsetting properties and development running performance and may cause neither melt sticking of toner to photosensitive member nor turn-up of cleaning blade.

The present invention is concerned with a toner containing at least a binder resin, a colorant and a wax; the wax comprising i) being an oxidized hydrocarbon wax, ii) having a hydroxyl value of from 5 mgKOH/g or more to 150 mgKOH/g or less, and iii) having, in molecular weight distribution measured by gel permeation chromatography of tetrahydrofuran-soluble matter, a main peak within the range of molecular weight of from 200 or more to 600 or less, and a component with a molecular weight of 700 or more in a content of 3% by mass or less.

The toner of the present invention is a toner having superior low-temperature fixing performance, high-temperature anti-offsetting properties and development running performance. Further, the toner of the present invention is a toner which may cause neither melt sticking of toner to photosensitive member nor turn-up of cleaning blade.

DETAILED DESCRIPTION OF THE INVENTION

As result of studies made by the present inventors, it has turn out that the toner which has superior low-temperature fixing performance, high-temperature anti-offsetting properties and development running performance and may cause neither melt sticking of toner to photosensitive member nor turn-up of cleaning blade can be obtained by so controlling an oxidized hydrocarbon wax as to have a hydroxyl value of from 5 mgKOH/g or more to 150 mgKOH/g or less and have, in its molecular weight distribution, a main peak within the range of molecular weight of from 200 or more to 600 or less and a component with a molecular weight of 700 or more in a content of 3% by mass.

Where a hydrocarbon wax is oxidized to introduce a hydroxyl group thereinto, a by-product of oxidation reaction is formed. In particular, in an attempt to make the hydrocarbon wax have a higher hydroxyl value, reaction conditions come into those which make the oxidation reaction more proceed, and hence by-products tend to be formed which have a carboxyl group and a ketone group, having been more oxidized than the introduction of the hydroxyl group. The carboxyl group may readily form an ester linkage with the hydroxyl group, and hence, of these by-products, in particular the molecule having the carboxyl group undergoes ester linking with the molecule having the hydroxyl group, to come into a larger molecule. The component thus formed is detected as a component having a molecular weight of 700 or more. The component having a molecular weight of 700 or more is a molecule that has come large by the ester linking of small molecules, and hence has many carboxyl groups, hydroxyl groups and ester groups in the molecule, thus having a great polarity. Hence, it has a lower crystallizability and a lower melting point than a component having a molecular weight of less than 700, and shows properties that it is viscous even at normal temperature. If such a component is contained in a toner in a large quantity, the toner tends to have low fluidity and chargeability.

Further, such a component has a great polarity and has a high compatibility with a styrene acrylic resin and a polyester resin which are used in a binder resin of a toner. Hence, it comes dispersed with the binder resin uniformly at a molecular level to function as a plasticizer. As the result, the toner tends to have a low mechanical strength and low anti-blocking properties, so that, where a mechanical stress is applied to the toner in a high-temperature environment, particles of the toner may tend to come deformed. In particular, toner particles present at a portion where the photosensitive member and the cleaning blade come into contact with each other are strongly rubbed by the photosensitive member and cleaning blade to come deformed, and come to be rubbed against the photosensitive member to tend to cause the melt sticking of toner. The toner particles present at a portion where the photosensitive member and the cleaning blade come into contact with each other also undergoes plastic deformation to come to have a viscosity, and hence the coefficient of friction between the photosensitive member and the cleaning blade may increase, so that the cleaning blade may turn up to cause faulty cleaning in some cases.

It is important for the oxidized hydrocarbon wax used in the present invention to have a hydroxyl value of from 5 mgKOH/g or more to 150 mgKOH/g or less, preferably from 10 mgKOH/g or more to 120 mgKOH/g or less, and more preferably from 20 mgKOH/g or more to 100 mgKOH/g or less. Controlling the hydroxyl value within this range enables the wax to be kept balanced between its dispersibility in toner particles and the rate of its exudation to the surfaces of toner particles, thus a toner can be obtained which shows a good developing performance while achieving both superior low-temperature fixing performance and superior high-temperature anti-offsetting properties.

If the wax has a hydroxyl value of less than 5 mgKOH/g, the wax may come low dispersible in toner particles to tend to make the toner have a low developing performance. If on the other hand the wax has a hydroxyl value of more than 150 mgKOH/g, the wax may exude to the surfaces of toner particles at a low rate to tend to make the toner have a low low-temperature fixing performance and low high-temperature anti-offsetting properties.

In the present invention, the oxidized hydrocarbon wax is also required to have, in its molecular weight distribution, a main peak within the range of molecular weight of from 200 or more to 600 or less, and preferably molecular weight of from 300 or more to 600 or less. The wax having the main peak within this range enables improvement in low-temperature fixing performance of the toner while keeping its anti-blocking properties. If the wax has the main peak at a molecular weight of less than 200, the toner tends to have low anti-blocking properties. If it has the main peak at a molecular weight of more than 600, the effect of improving the low-temperature fixing performance is obtainable with difficulty.

In the present invention, the oxidized hydrocarbon wax is further required to have, in its molecular weight distribution, a component with a molecular weight of 700 or more in a content of 3% by mass or less, preferably 2% by mass or less, and more preferably 1% by mass or less. If the wax has the component with a molecular weight of 700 or more in a content of more than 3% by mass, as stated previously the toner may tends to have low fluidity and chargeability, or the toner tends to have a low mechanical strength to deteriorate or tends to have low anti-blocking properties. It may also come about that the toner tends to melt-stick to the photosensitive member or the faulty cleaning occurs because of the turn-up of the cleaning blade.

In the present invention, as a method for controlling the component with a molecular weight of 700 or more to be in a content of 3% by mass or less in regard to the molecular weight distribution of the oxidized hydrocarbon wax, a method is preferred in which the oxidized hydrocarbon wax is purified with a solvent.

If it is attempted to reduce the component with a molecular weight of 700 or more by controlling conditions for oxidation reaction, mild reaction conditions must be selected in order to make any by-product not easily formed. In such a case, the oxidation reaction takes a very long time in order to obtain the oxidized hydrocarbon wax having the desired hydroxyl value, or the reaction may not well proceed to make the desired hydroxyl value not obtainable in some cases.

In contrast thereto, in the method in which the oxidized hydrocarbon wax is purified with a solvent to lessen its content of the component with a molecular weight of 700 or more, the greater part of any by-product can be removed in the step of purification even if the by-products are in a large quantity, and hence the conditions for oxidation reaction can be made less restrictive. Thus, this makes it able to obtain a wax having a high hydroxyl value and less by-products or to obtain a wax having less by-products even if the oxidation reaction is made to proceed in a short time.

The solvent used in purifying the oxidized hydrocarbon wax may include as types thereof alcohols such as methanol, ethanol, 1-propanol, 2-propanol, isopropanol, 1-butanol, 2-butanol and tert-butanol; aliphatic hydrocarbons such as n-hexane, n-heptane, n-octane and cyclohexane; aromatic hydrocarbons such as benzene, toluene, xylene and ethylbenzene; and ketones such as acetone, methyl ethyl ketone, diethyl ketone and isobutyl methyl ketone. In particular, alcohols and ketones may preferably be used. Of these, methanol or ethanol may particularly preferably be used.

As the method for purifying the oxidized hydrocarbon wax, it may include a method in which a mixture of the wax and the solvent is heated, and then cooled after the wax has stood dissolved in the solvent, where the wax having been purified is precipitated and the wax having been precipitated is taken out by decantation or filtration; and a method of solvent washing in which the wax is previously pulverized and the wax pulverized is added to and mixed in the solvent, where by-products are subjected to solvent extraction from a wax powder in a solid-liquid state that the wax is not made to dissolve in the solvent, and thereafter the wax having been purified is taken out by decantation or filtration. From the viewpoint of improving the degree of purification, the method is preferred in which the wax is heated to first make it dissolve completely in the solvent, followed by cooling to precipitate the wax. From the viewpoint of cost and readiness of management, the method of solvent washing is preferred.

As to the method of purification, it may appropriately be selected taking account of cost and productivity. By whatever method the purification is carried out, it is important that the component with a molecular weight of 700 or more of the oxidized hydrocarbon wax is so controlled as to be in a content of 3% by mass or less.

As the wax in the present invention, an aliphatic hydrocarbon wax may be subjected to alcohol conversion to obtain the wax having the desired characteristics. This is preferable in view of an advantage that the conversion of hydroxyl groups of the wax can be controlled with ease.

The aliphatic hydrocarbon wax may have a main peak within the range of molecular weight of from 200 or more to 600 or less in terms of polystyrene as measured by gel permeation chromatography (GPC). This is preferable in order to control molecular weight distribution of the oxidized hydrocarbon wax formed after the alcohol conversion. A saturated or unsaturated aliphatic hydrocarbon wax may also preferably be used which has number average molecular weight (Mn) within the range of from 100 to 3,000, and more preferably from 200 to 2,000, in terms of polystyrene.

The molecular weight distribution of the wax in the present invention is measured by gel permeation chromatography (GPC) in the following way.

To o-dichlorobenzene for gel chromatographs, 2,6-di-t-butyl-4-methylphenol (BHT) is so added as to be in a concentration of 0.10 wt/vol. %, and dissolved at room temperature. The wax and the o-dichlorobenzene to which the BHT has been added are put into a sample bottle, and then heated on a hot plate set at 150° C., to make the wax dissolve. After the wax has dissolved, it is put into a filter unit having beforehand been kept heated, and this is set in the main body. What has been made to pass through the filter unit is used as a GPC sample. Here, a sample solution is so prepared as to be in a concentration of about 0.15% by mass. This sample solution is used to make measurement under the following conditions.

Instrument: HLC-8121GPC/HT (manufactured by Tosoh Corporation).

Detector: RI for high temperature.

Columns: TSKgel GMHHR-H HT, combination of two columns (available from Tosoh Corporation).

Temperature: 135.0° C.

Solvent: o-Dichlorobenzene for gel chromatographs (0.10 wt/vol. % BHT-added).

Flow rate: 1.0 ml/min.

Amount of sample injected: 0.4 ml.

To calculate the molecular weight of the wax, a molecular weight calibration curve is used which is prepared using a standard polystyrene resin (e.g., trade name: TSK Standard Polystyrene F-850, F-450, F-288, F-128, F-80, F-40, F-20, F-10, F-4, F-2, F-1, A-5000, A-2500, A-1000, A-500, available from Tosoh Corporation).

In the measurement of the oxidized hydrocarbon wax, the content of the component with a molecular weight of 700 or more is calculated in the following way. The total sum of area of all peaks in the molecular weight distribution detected as a result of the measurement of the oxidized hydrocarbon wax is regarded as 100 area %. The proportion (area %) in which the area of peaks fractioned at a molecular weight of 700 or more holds in the total area is calculated, and is termed as the content of the component with a molecular weight of 700 or more.

In the present invention, the proportion (area %) of peak area at a molecular weight of 700 or more that has been calculated in the GPC measurement of the wax is termed as the content (% by mass) of the component with a molecular weight of 700 or more.

As the aliphatic hydrocarbon wax, usable are, e.g., (A) a higher aliphatic unsaturated hydrocarbon wax having at least one double bond, obtained by an ethylene polymerization process or an olefination process carried out by thermal decomposition of a petroleum hydrocarbon, (B) an n-paraffin mixture obtained from petroleum fractions, (C) a polyethylene wax obtained by an ethylene polymerization process, and (D) one or two or more kinds of a higher aliphatic hydrocarbon obtained by a Fischer-Tropsch synthesis process. In particular, (B) or (D) may preferably be used.

As a production example of the wax, it may be obtained by, e.g., subjecting the aliphatic hydrocarbon wax to liquid-phase oxidation with a molecule-shaped oxygen-containing gas in the presence of boric acid and boric anhydride. A mixture of boric acid and boric anhydride may be used as a catalyst. The boric acid and the boric anhydride may preferably be in a mixing ratio (boric acid/boric anhydride) within the range of from 1 to 2, and preferably from 1.2 to 1.7, in molar ratio. If the boric anhydride is in a proportion below the above range, any excess matter of the boric acid may cause a phenomenon of agglomeration, undesirably. If on the other hand the boric anhydride is in a proportion above the above range, a powdery substance coming from the boric anhydride is collected after the reaction or any excess boric anhydride does not participate in the reaction, thus this is undesirable from an economical standpoint as well.

The boric acid and boric anhydride to be used may be added in an amount of from 0.001 mole or more to 10 moles or less, and particularly from 0.1 mole or more to 1.0 mole or less, per mole of the raw-material hydrocarbon where the mixture of these are converted as the amount of boric acid.

As the molecule-shaped oxygen-containing gas, usable are comprehensively available gases obtained by diluting oxygen or air, or these, with an inert gas. What is preferred is one having an oxygen concentration of from 1% by volume or more to 30% by volume or less, and more preferably from 3% by volume or more to 20% by volume or less.

The liquid-phase oxidation reaction is carried out in a molten state of the raw-material hydrocarbon, usually without use of any solvent. Reaction temperature may be set at from 120° C. or more to 280° C. or less, and preferably from 150° C. or more to 250° C. or less. Reaction time may preferably be set at from 1 hour or more to 15 hours or less.

The boric acid and the boric anhydride boric acid may preferably be added to the reaction system in the state they have previously been mixed. If the boric acid only is added alone, dehydration reaction or the like of the boric acid may take place, undesirably. Also, such a mixed solvent of the boric acid and the boric anhydride may be added at a temperature of from 100° C. or more to 180° C. or less, and preferably from 110° C. or more to 160° C. or less. If it is added at a temperature lower than 100° C., the boric anhydride may show a low catalytic activity, undesirably, because of, e.g., water and the like remaining in the system.

After the reaction has been completed, water may be added to the reaction mixture, and a borate of the wax formed may be hydrolyzed, followed by purification to obtain the desired wax.

The wax in the present invention may preferably have an ester value of from 0.1 mgKOH/g or more to 50 mgKOH/g or less, and more preferably from 0.1 mgKOH/g or more to 30 mgKOH/g or less.

Where the wax has its ester value within the above range, the wax can be made to be better dispersible in the toner particles. Such a wax can also be appropriately compatible with the binder resin, may less so act as to lower the mechanical strength of the binder resin, and can keep the toner from deteriorating or showing a low development running performance.

The wax in the present invention may have an acid value of from 0.1 mgKOH/g or more to 50 mgKOH/g or less, preferably from 0.1 mgKOH/g or more to 30 mgKOH/g or less, and more preferably from 0.1 mgKOH/g or more to 20 mgKOH/g or less.

Inasmuch as the wax has an acid group, the wax can not easily inhibit the toner from being electrostatically charged, and hence, even when the wax is added in a large quantity, the chargeability of the toner can be kept in a good state. As the result, the toner can enjoy better achievement of both the low-temperature fixing performance and the developing performance.

Where the wax has its acid within the above range, the effect brought by having an acid group can sufficiently be obtained. In addition, the toner can be kept from lowering in its developing performance even in a high-temperature and high-humidity environment.

In the present invention, the hydroxyl value, acid value and ester value of the wax are determined by the following methods. Basic operation is made according to JIS K 0070.

Measurement of Acid Value

The acid value is the number of milligrams of potassium hydroxide necessary to neutralize the acid contained in 1 g of a sample. Stated specifically, it is measured according to the following procedure.

(1) Preparation of Reagent 1.0 g of Phenolphthalein is dissolved in 90 ml of ethyl alcohol (95 vol. %), and ion-exchanged water is so added thereto as to add up to 100 ml to obtain a phenolphthalein solution.

7 g of Guaranteed potassium hydroxide is dissolved in 5 ml of water, and ethyl alcohol (95 vol. %) is so added thereto as to add up to 1 liter. So as not to be exposed to carbon dioxide and so forth, this solution is put into an alkali-resistant container and then left to stand for 3 days, followed by filtration to obtain a potassium hydroxide solution. The potassium hydroxide solution obtained is stored in an alkali-resistant container. For the factor of the potassium hydroxide solution, 25 ml of 0.1 mole/liter hydrochloric acid is taken into an Erlenmeyer flask, and a few drops of the phenolphthalein solution are added thereto to carry out titration with the potassium hydroxide solution, where the factor is determined from the amount of the potassium hydroxide required for neutralization. As the 0.1 mole/liter hydrochloric acid, one prepared according to JIS K 8001-1998 is used.

(2) Operation (A) Main Test 2.0 g of Wax having been pulverized is precisely weighed out in a 200 ml Erlenmeyer flask, and 100 ml of a solvent (prepared by mixing diethyl ether and ethanol (99.5) in a volume ratio of 1:1 or 2:1) is added thereto to make the former dissolve in the latter over a period of 5 hours. Next, to the solution obtained, a few drops of the phenolphthalein solution are added as an indicator to carry out titration with the above potassium hydroxide solution. Here, the end point of titration is the point of time where pale deep red of the indicator has continued for about 30 seconds.

(B) Blank Test

Titration is carried out according to the same procedure as the above except that the sample is not used (i.e., only the mixed solvent of diethyl ether and ethanol is used).

(3) The results obtained are substituted for the following equation to calculate the acid value.

$$A=[(C-B]\times f\times 5.61]/S$$

where A is the acid value (mgKOH/g), B is the amount (ml) of the potassium hydroxide solution in the blank test, C is the amount (ml) of the potassium hydroxide solution in the main test, f is the factor of the potassium hydroxide solution, and S is the sample (g).

Measurement of Hydroxyl Value

The hydroxyl value is the number of milligrams of potassium hydroxide necessary to neutralize acetic acid bonded to hydroxyl groups, when 1 g of a sample is acetylated. Stated specifically, it is measured according to the following procedure.

(1) Preparation of Reagent 25 g of Guaranteed acetic anhydride is put into a 100 ml measuring flask, and pyridine is so added thereto as to add up to 100 ml in total mass, and these are thoroughly mixed by shaking to obtain an acetylating reagent. The acetylating reagent obtained is stored in a brown bottle so as not to be exposed to moisture, carbon dioxide and so forth.

1.0 g of Phenolphthalein is dissolved in 90 ml of ethyl alcohol (95 vol. %), and ion-exchanged water is so added thereto as to add up to 100 ml to obtain a phenolphthalein solution.

35 g of Guaranteed potassium hydroxide is dissolved in 20 ml of water, and ethyl alcohol (95 vol. %) is so added thereto as to add up to 1 liter. So as not to be exposed to carbon dioxide and so forth, this solution is put into an alkali-resistant container and then left to stand for 3 days, followed by filtration to obtain a potassium hydroxide solution. The potassium hydroxide solution obtained is stored in an alkali-resistant container. For the factor of the potassium hydroxide solution, 25 ml of 0.5 mole/liter hydrochloric acid is taken into an Erlenmeyer flask, and a few drops of the phenolphthalein solution are added thereto to carry out titration with the potassium hydroxide solution, where the factor is determined from the amount of the potassium hydroxide required for neutralization. As the 0.5 mole/liter hydrochloric acid, one prepared according to JIS K 8001-1998 is used.

(2) Operation (A) Main Test 1.0 g of Wax having been pulverized is precisely weighed out in a 200 ml round-bottom flask, and 5.0 ml of the above acetylating reagent is accurately added thereto by using a transfer pipette. Here, if the sample can not easily dissolve in the acetylating reagent, guaranteed toluene is added in a small quantity to effect dissolution.

A small funnel is placed at the mouth of the flask, and its bottom is immersed by about 1 cm in a temperature 97° C. glycerol bath and heated. In order to prevent the neck of the flask from being heated by the heat of the glycerol bath, it is preferable to cover the base of the neck of the flask with a cardboard disk with a round hole made in the middle.

One hour later, the flask is taken out of the glycerol bath, and then left to cool. After it has been left to cool, 1 ml of water is added thereto through the funnel, followed by shaking to hydrolyze acetic anhydride. In order to further hydrolyze it completely, the flask is again heated in the glycerol bath for 10 minutes. After it has been left to cool, the walls of the funnel and flask are washed with 5 ml of ethyl alcohol.

A few drops of the above phenolphthalein solution are added as an indicator to carry out titration with the potassium hydroxide solution. Here, the end point of titration is the point of time where pale deep red of the indicator has continued for about 30 seconds.

(B) Blank Test

Titration is carried out according to the same procedure as the above except that the wax sample is not used.

(3) The results obtained are substituted for the following equation to calculate the hydroxyl value.

$$A=[\{(B-C)\times 28.05\times f\}/S]+D$$

where A is the hydroxyl value (mgKOH/g), B is the amount (ml) of the potassium hydroxide solution in the blank test, C is the amount (ml) of the potassium hydroxide solution in the main test, f is the factor of the potassium hydroxide solution, S is the sample (g), and D is the acid value (mgKOH/g) of the wax.

Measurement of Ester Value

Calculated According to the Following Equation

Ester value=(saponification value)(acid value).

Measurement of Saponification Value

Implements and Tools

Erlenmeyer flask (200 to 300 ml).

Air condenser (a glass tube of 6 to 8 mm in outer diameter and 100 cm in length or a reflux condenser, either of which is one which is ground-in connectable to the mouth of the Erlenmeyer flask).

Water bath, sand bath or hot plate (one which is controllable to a temperature of about 80° C.).

Burette (50 ml).

Transfer pipette (25 ml).

Reagents:

0.5 kmole/$m^3$ Hydrochloric acid.

0.5 kmole/$m^3$ Potassium hydroxide ethanol solution.

Phenolphthalein solution.

Measuring Method:

(a) From 1.5 to 3.0 g of the wax is precisely weighed out in the Erlenmeyer flask up to the figure of 1 mg.

(b) 25 ml of the 0.5 kmole/$m^3$ potassium hydroxide ethanol solution is all added thereto by using the transfer pipette.

(c) The air condenser is attached to the Erlenmeyer flask, and the reaction is carried out with gentle heating on the water bath, sand bath or hot plate for 30 minutes while its contents are mixed by shaking it sometimes. When heated, the heating temperature is so controlled that the ring of ethanol being refluxed does not reach the top of the air condenser.

(d) After the reaction has been completed, the contents are immediately cooled, and, before they harden in the form of agar, water or a xylene-ethanol 1:3 mixed solvent are sprayed in a small quantity from above the air condenser to wash its inner wall. Thereafter, the air condenser is detached.

(e) 1 ml of the phenolphthalein solution is added as an indicator to carry out titration with the 0.5 kmol/$m^3$ hydrochloric acid, and the point of time where pale deep red of the indicator comes no longer to appear for about one minute is regarded as the end point.

(f) As an blank test, the procedure (a) to (e) is repeated without adding any wax.

(g) Where the sample does not readily dissolve, xylene or a xylene-ethanol mixed solvent is added to dissolve the sample.

Calculation $$A=\{(B-C)\times 28.05\times f\}/S$$

where; A is the saponification value (mgKOH/g); B is the amount (ml) of the 0.5 kmol/$m^3$ hydrochloric acid used in the blank test; C is the amount (ml) of the 0.5 kmol/$m^3$ hydrochloric acid used in the titration; f is the factor of the 0.5 kmol/$m^3$ hydrochloric acid; S is the mass (g) of the wax; and 28.05 is the value of (formula mass 56.11 of potassium hydroxide)×½.

In measuring the acid value, hydroxyl value, ester value and saponification value of the wax contained in the toner in the present invention, the wax may be separated from the toner and thereafter the measurement may be made according to the above measuring methods.

The oxidized hydrocarbon wax in the present invention may also preferably have a melting point of from 60° C. or more to 100° C. or less, preferably from 70° C. or more to 90° C. or less, and more preferably from 70° C. or more to 80° C. or less. The use of the oxidized hydrocarbon wax having a melting point within this range enables improvement in low-temperature fixing performance of the toner while better maintaining its anti-blocking properties and development running performance.

In the present invention, the melting point of the wax may be measured with a differential scanning calorimetry analyzer (a DSC measuring instrument), e.g., Q1000, manufactured by TA Instruments Japan Ltd. As its measuring method, it is measured according to ASTM D3418-82. As a DSC curve used in the present invention, a DSC curve is used which is obtained by measurement when a sample is heated once to take a pre-history, thereafter cooled at a cooling rate of 10° C./min and thereafter heated. The measurement may be made under the following conditions.

Measurement of Melting Point of Wax

The melting point of the wax is measured according to ASTM D3418-82, using a differential scanning calorimetry analyzer "Q1000" (manufactured by TA Instruments Japan Ltd.).

The temperature at the detecting portion of the instrument is corrected on the basis of melting points of indium and zinc, and the amount of heat is corrected on the basis of heat of fusion of indium.

Stated specifically, the wax is precisely weighed in an amount of about 1 mg, and this is put into a pan made of aluminum and an empty pan made of aluminum is used as reference. Measurement is made at a heating rate of 10° C./min within the measurement temperature range of from 30° C. to 200° C. Here, in the measurement, the wax is first heated to 200° C., then cooled to 30° C. and thereafter heated again. In the course of this second-time heating, a maximum endothermic peak obtained in the temperature range of from 30° C. to 200° C. is regarded as the melting point of the wax.

The oxidized hydrocarbon wax in the present invention may be added to toner particles preferably in an amount ranging from 0.1 part by mass or more to 20 parts by mass or less, more preferably from 0.5 part by mass or more to 15 parts by mass or less, and still more preferably from 1 part by mass or more to 10 parts by mass or less, based on 100 parts by mass of the binder resin.

The wax in the present invention may be used in combination with any known wax used conventionally commonly used in toners. Such a known wax is exemplified by paraffin wax and derivatives thereof, montan wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft modified products.

Such a known wax may be used in an amount ranging from 0.1 part by mass or more to 15 parts by mass or less, and preferably from 1 part by mass or more to 10 parts by mass or less, based on 100 parts by mass of the binder resin.

As types of the binder resin used in the toner particles of the present invention, it may include styrene resins, styrene copolymer resins, polyester resins, polyol resins, polyvinyl chloride resins, phenol resins, natural resin modified phenol resins, natural resin modified maleic acid resins, acrylic resins, methacrylic resins, polyvinyl acetate resins, silicone resins, polyurethane resins, polyamide resins, furan resins, epoxy resins, xylene resins, polyvinyl butyral resins, terpene resins, coumarone indene resins, and petroleum resins. In particular, polyester resin and styrene copolymer resin may preferably be used, which may less cause environmental variations in chargeability of the toner and promise superior fixing performance of the toner. Further, what may more preferably be used is a hybrid resin formed as a composite of both polyester resin and styrene copolymer resin.

In particular, as a binder resin used preferably in the present invention, it may include a binder resin containing 50% by mass or more of a polyester unit at least. The feature that it contains 50% by mass or more of a polyester unit enables securement of a good low-temperature fixing performance of the toner. The content of the polyester unit in the present invention refers to the content in total of what is present as the polyester resin and a component present as a polyester resin component in the hybrid resin.

Further, the binder resin to be contained in the toner used in the present invention may contain in the binder resin a vinyl polymer unit in an amount of 50% by mass or less, and preferably from 10 to 50% by mass. This is preferable in view of an advantage that the toner can have good high-temperature anti-offsetting properties.

In the present invention, it is preferable to contain the hybrid resin as the binder resin. The hybrid resin has a very high affinity for the oxidized hydrocarbon wax having a hydroxyl group. Hence, combination of the both can make the hybrid resin also soften quickly when the wax has melted by the heat at the time of fixing, and this enables the toner to be vastly improved in low-temperature fixing performance. The oxidized hydrocarbon wax used in the present invention has the component with a molecular weight of 700 or more in a content of 3% by mass or less, and hence has an appropriate crystallizability. It also has an appropriate affinity for the hybrid resin, and hence may by no means make the hybrid resin soften in excess even at normal temperature. Thus, it can bring a remarkable effect in regard to the development running performance and the anti-blocking properties.

That is, the oxidized hydrocarbon wax used in the present invention, having the component with a molecular weight of 700 or more in a content of 3% by mass or less, may be used in combination with the hybrid resin, and this can more enhance the effect to be brought by the former.

The binder resin used in the present invention may be one making use of the hybrid resin alone. It may also be a mixture containing any other resin component.

For example, the mixture may include a mixture of the hybrid resin and a vinyl resin, a mixture of the hybrid resin and the polyester resin, and a mixture of the polyester resin, the hybrid resin and the vinyl resin.

The hybrid resin may include the following. (i) One formed by carrying out ester interchange reaction between a vinyl resin component produced by polymerizing a monomer component having a carboxylate such as acrylate or methacrylate and a polyester resin component, (ii) one formed by esterification reaction taken place between a vinyl resin component produced by polymerizing a monomer component having a carboxylate such as acrylate or methacrylate and a polyester resin component, and (iii) one formed by polymerizing a vinyl monomer in the presence of an unsaturated polyester resin component produced by polymerization making use of a monomer having an unsaturated bond such as fumaric acid.

The hybrid resin may be obtained by, as in the above (i) and (ii), incorporating a vinyl resin component and/or a polyester resin component with a monomer capable of reacting with both the resin components and allowing these to react with each other. Of the monomers making up the polyester resin component, the monomer capable of reacting with a vinyl resin component may include unsaturated dicarboxylic acids such as fumaric acid, maleic acid, citraconic acid and itaconic acid or anhydrides of these. Of the monomers making up the vinyl resin component, the monomer capable of reacting with a polyester resin component may include vinyl monomers having a carboxylic group, such as acrylic acid and methacrylic acid, and vinyl monomers having a hydroxyl group.

As methods by which the hybrid resin used in the present invention can be produced may include, e.g., production methods shown in the following (1) to (5).

(1) A vinyl resin and a polyester resin are first separately produced and thereafter these are dissolved and swelled in a small amount of an organic solvent, followed by addition of an esterifying catalyst and an alcohol and then heating to effect ester interchange reaction to obtain the hybrid resin having a polyester resin component and a vinyl resin component.

(2) A vinyl resin is first produced and thereafter a polyester resin component is produced in the presence of the vinyl resin to produce the hybrid resin having a polyester resin component and a vinyl resin component. In this case, too, an organic solvent may appropriately be used.

(3) A polyester resin is first produced and thereafter a vinyl resin component is produced in the presence of the polyester resin, and these are allowed to react with each other to produce the hybrid resin having a polyester resin component and a vinyl resin component.

(4) A vinyl resin and a polyester resin are first produced and thereafter a vinyl monomer and/or a polyester monomer (such as an alcohol or a carboxylic acid) is/are added in the presence of these polymer components to produce the hybrid resin. In this case, too, an organic solvent may appropriately be used.

(5) A vinyl monomer and a polyester monomer (such as an alcohol or a carboxylic acid) are mixed to effect addition polymerization and polycondensation reaction continuously, to produce the hybrid resin having a polyester resin component and a vinyl resin component. An organic solvent may further appropriately be used.

In the above production methods (1) to (5), a plurality of polymer components having different molecular weights and different degrees of cross-linking may be used as the vinyl polymer component and/or the polyester resin component.

In the present invention, the method (3) is available as a hybrid resin production method used preferably. In particular, a hybrid resin is preferred which is obtained by dissolving in a vinyl monomer an unsaturated polyester resin capable of reacting with the vinyl monomer, and polymerizing a mixture of the polyester resin and the vinyl monomer by bulk polymerization.

In the bulk polymerization, the vinyl resin component can be made to have a large molecular weight and the vinyl resin component contained in a gel component can be made to have a large peak molecular weight. Hence, this process may preferably be used in the present invention.

In addition, the bulk polymerization, compared with solution polymerization, does not require any step of evaporating the solvent, and hence the binder resin can be obtained at a low cost. Further, the binder resin produced by bulk polymerization may less contain impurities such as a dispersant than a binder resin produced by suspension polymerization, and hence it may less affect triboelectric chargeability of the toner, and is very preferable as the binder resin for the toner.

In particular, the binder resin used in the present invention may preferably be a hybrid resin obtained by subjecting a vinyl monomer to bulk polymerization in the presence of a low-molecular weight polyester resin having an unsaturated polyester resin, in a mass ratio of the low-molecular weight polyester resin to the vinyl monomer of from 50:50 to 90:10, and preferably from 60:40 to 80:20. If the low-molecular weight polyester resin is in a mass ratio of less than 50:50, the toner tends to have a low low-temperature fixing performance. If it is in a mass ratio of more than 90:10, the toner tends to have low high-temperature anti-offsetting properties.

Inasmuch as the vinyl monomer is subjected to bulk polymerization in the presence of such an unsaturated polyester resin component (particularly preferably an unsaturated linear polyester resin component), a hybrid resin component can be obtained which has a molecular structure in such a form that it has as the backbone chain a vinyl resin component having a large molecular weight and a high chain straightness and the low-molecular weight polyester resin component is branched from the vinyl resin component. Further, acid groups and hydroxyl groups in the hybrid resin having such a branched structure form a gel component as a result of esterification combination between molecules.

In the gel component thus obtained, the hybrid resin that is a constituent unit has a regular molecular structure, and hence the molecular structure of the gel component may also regularly be made up with ease, thus the toner can have a superior property of sharp melting by heat and its low-temperature fixing performance is not inhibited. Moreover, in virtue of the bulk polymerization of the vinyl monomer, a vinyl polymer unit in the hybrid resin component that is a constituent unit of the gel component can be made to have a large molecular weight, and hence the gel component can also have a large molecular weight, can maintain a high viscosity even at a high temperature and can improve high-temperature anti-offsetting properties of the toner.

In the toner of the present invention which makes use of the hybrid resin, tetrahydrofuran-soluble matter of a component (hereinafter "residue" in some cases) separated by hydrolysis of a resin component insoluble in tetrahydrofuran and thereafter by filtration may preferably have, in its molecular weight distribution measured by GPC, a main peak within the range of molecular weight of from 10,000 to 1,000,000, more preferably molecular weight of from 30,000 to 500,000, and still more preferably molecular weight of from 50,000 to 300,000. When a hybrid resin component insoluble in tetrahydrofuran is hydrolyzed, the component decomposed is a polyester unit having been made into a polymer through an ester linkage, and the vinyl polymer unit is not decomposed and remains in the state of a polymer. Hence, the residue remaining after the hydrolysis is one consisting chiefly of the vinyl polymer unit, and the tetrahydrofuran-soluble matter of the residue means tetrahydrofuran-soluble matter of the vinyl polymer unit.

Where the polyester resin and a vinyl resin that may have a main peak within the range of molecular weight of from 10,000 to 1,000,000 are merely mixed to produce the binder resin, such a vinyl resin becomes tetrahydrofuran-soluble matter, and comes not to be contained in the tetrahydrofuran-insoluble matter at the initial stage. Also, where the polyester resin and a vinyl resin containing tetrahydrofuran-insoluble matter are merely mixed to produce the binder resin, the vinyl resin remains in the tetrahydrofuran-insoluble matter, but keeps on being tetrahydrofuran-insoluble matter also after the hydrolysis. Hence, in either case, the make-up as described above that is preferable as the hybrid resin does not come.

The hybrid resin component that may satisfy the preferable make-up described above comes into existence when, e.g., the polyester resin and the vinyl resin having a main peak within the range of molecular weight of from 10,000 to 1,000,000 are hybridized, and come into tetrahydrofuran-insoluble matter as the result that they have been hybridized.

Thus, the fact that the tetrahydrofuran-soluble matter of the residue has a main peak within the range of molecular weight of from 10,000 to 1,000,000 shows that the vinyl polymer unit having a large molecular weight (i.e., having a main peak within the range of molecular weight of from 10,000 to 1,000,000) and the polyester unit have been made to stand hybridized.

That is, such a binder resin in which the tetrahydrofuran-soluble matter of the residue separated by hydrolyzing the tetrahydrofuran-insoluble matter coming from the resin component has a main peak within the range of molecular weight of from 10,000 to 1,000,000 in its molecular weight distribution measured by GPC is a resin having a large molecular weight and having a gel structure with a large molecular weight between cross-linking points. The molecular weight between cross-linking points is the molecular weight between branching points that comes when resin molecules come branched to form a cross-linked structure. Being large in molecular weight between cross-linking points brings the resin molecules having a long distance between their branching points, and hence this weakens the force by which the molecules bind themselves one another in a network form. As the result, the molecules can readily move at the time of heating, thus a soft gel component can be obtained. Hence, when used as the binder resin for toner, the gel component can not easily come to cut even when toner particles are produced through melt kneading, and this enables achievement of good high-temperature anti-offsetting properties of the toner.

In the toner containing such a tetrahydrofuran-insoluble matter, the tetrahydrofuran-insoluble matter that is the gel component can readily make molecular movement even at a small amount of heat at the time of fixing. This makes the binder resin more readily soften by heat than a case in which the binder resin contains a gel component having a small molecular weight between cross-linking points. Hence, the toner is improved in low-temperature fixing performance. Further, such a gel component enables the wax to maintain a high viscosity even at a high temperature, thus the toner can be improved in high-temperature anti-offsetting properties. The toner can also maintain high-temperature anti-offsetting properties even if the gel component is in a small quantity, and hence a low-molecular weight component may be much contained. This enables the toner to be further improved in low-temperature fixing performance. In addition, as long as the tetrahydrofuran-soluble matter of the residue has a molecular weight of from about 10,000 to about 1,000,000 in its molecular weight distribution measured by GPC, the action that inhibits dispersion of other components contained in the toner particles can be too small to cause any especial problem.

The molecular weight distribution of the tetrahydrofuran-soluble matter of the residue separated by hydrolyzing the polyester unit contained in the tetrahydrofuran-insoluble matter may be measured according to the procedure as shown below.

First, the tetrahydrofuran-insoluble matter coming from the resin component is taken out of toner particles, and then this tetrahydrofuran-insoluble matter is heated in an alkaline aqueous solution to hydrolyze the polyester resin unit to remove it. The vinyl resin component is not hydrolyzed and remains as a resin component, and hence the residue is extracted and its molecular weight distribution is measured by GPC. A specific measuring method is shown below.

(1) Separation of Tetrahydrofuran-insoluble Matter

The toner is weighed out, which is then put in a cylindrical filter paper [e.g., No. 86R, 28 mm (height)×10 mm (diameter) in, size, available from Toyo Roshi Kaisha, Ltd.], and this is set on a Soxhlet extractor. The tetrahydrofuran-soluble matter is extracted for 16 hours using 200 ml of tetrahydrofuran as a solvent. At this point, extraction is carried out at such a reflux speed that the extraction cycle of the solvent is one time per about 4 to 5 minutes. After the extraction is completed, the cylindrical filter paper is taken out, and then the tetrahydrofuran-insoluble matter left on the cylindrical filter paper is collected.

Where the toner is a magnetic toner containing a magnetic material, the tetrahydrofuran-insoluble matter thus collected is put into a beaker, and tetrahydrofuran is added thereto. These are well dispersed, and thereafter a magnet is set close to the bottom of the beaker to make the magnetic material precipitate and stationary to the bottom of the beaker. In this state, the tetrahydrofuran and the gel component standing dispersed in the tetrahydrofuran are moved to another container to thereby remove the magnetic material, where the tetrahydrofuran is evaporated to separate the tetrahydrofuran-insoluble matter coming from the binder resin.

(2) Separation of Residue by Hydrolysis:

The tetrahydrofuran-insoluble matter coming from the binder resin, thus obtained, is dispersed in an aqueous 2 moles/liter NaOH solution in a concentration of 1% by mass, where, using a pressure-resistant container, hydrolysis is carried out under conditions of a temperature of 150° C. for 24 hours. From this hydrolysis solution, the residue after hydrolysis is separated by filtration according to any of the following procedures.

i) Where the tetrahydrofuran-insoluble matter does not contain any component having an ester structure:

The hydrolysis solution is suction-filtered by using a membrane filter to separate the residue. Thus, the monomer component that is a decomposition product of the polyester resin unit is removed to remain in the filtrate.

ii) Where the tetrahydrofuran-insoluble matter contains a component having an ester structure, such as acrylate or methacrylate:

The residue present in the hydrolysis solution has come into a sodium salt (—$COO^-Na^+$). Accordingly, after the residue has been separated by filtration, the residue is again dispersed in water. After the dispersion, hydrochloric acid is added to adjust the pH of the water to 2 to make the —$COO^-$ group the residue has, into —COOH. Thereafter, the residue is separated by filtration with a membrane filter.

(3) GPC Measurement of Component Separated in the Above (2)

The component separated in the above (2) is dissolved in tetrahydrofuran to make measurement of molecular weight distribution by GPC.

For the tetrahydrofuran-insoluble matter, it is also preferable to contain the vinyl polymer unit in an amount of from 20% by mass to 80% by mass, preferably from 30% by mass to 70% by mass, and more preferably from 40% by mass to 60% by mass. The content of the vinyl polymer unit in the tetrahydrofuran-insoluble matter may be measured in the following way.

First, a polyester resin is produced by polymerization under the same monomer composition as the monomer composition of the polyester resin component used in the polymerization for the hybrid resin. A vinyl polymer is also likewise produced by polymerization under the same monomer composition as the monomer composition of the vinyl polymer component used in the polymerization for the hybrid resin. The polyester resin and vinyl polymer thus obtained are well mixed, and the mixture obtained is used as a calibration curve sample. Several samples are prepared in which the polyester resin and the vinyl polymer are mixed in proportions changed arbitrarily, and a calibration curve is prepared by IR measurement. Using this calibration curve, the content of the vinyl polymer unit in the tetrahydrofuran-insoluble matter is calculated.

For example, in Hybrid Resin Production

Example 1 in working examples given later, as a peak of polyester resin, the sum of the area of a peak (about 730 $cm^{-1}$) due to the benzene ring of a phthalic acid unit and that of a peak (about 830 $cm^{-1}$) due to the benzene ring of a bisphenol derivative unit was set as a polyester resin portion, and, as a peak of vinyl polymer, the area of a peak (about 700 $cm^{-1}$) due to the benzene ring of a styrene unit was set as a vinyl polymer portion, where the content of the vinyl polymer unit was calculated on the basis of the calibration curve.

As the unsaturated polyester resin used in the hybrid resin obtained by bulk polymerization, it may preferably be such a low-molecular weight unsaturated polyester resin that may have a main peak within the range of molecular weight of from 2,000 to 30,000, preferably molecular weight of from 3,000 to 20,000, and more preferably molecular weight of from 5,000 to 15,000, in GPC molecular weight distribution of the tetrahydrofuran-soluble matter. Further, it may particularly preferable be a linear unsaturated polyester resin containing no gel component. As long as it has a main peak molecular weight within the above range, the toner can better achieve both developing performance and low-temperature fixing performance.

The unsaturated polyester resin used in the hybrid resin obtained by bulk polymerization in the present invention may also preferably have an acid value of from 0.1 mgKOH/g to 30 mgKOH/g, preferably from 1 mgKOH/g to 20 mgKOH/g, and more preferably from 1 mgKOH/g to 10 mgKOH/g, and a hydroxyl value of from 10 mgKOH/g to 60 mgKOH/g, preferably from 20 mgKOH/g to 60 mgKOH/g, and more preferably from 30 mgKOH/g to 50 mgKOH/g. This is preferable because the toner can be provided with a good triboelectric chargeability.

The monomer usable when the polyester unit is formed is exemplified below. As a dihydric alcohol component, it may include the following: Ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol represented by the following Formula (A) and derivatives thereof:

(A)

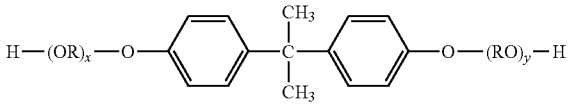

wherein R represents an ethylene group or a propylene group, x and y are each an integer of 0 or more, and an average value of x+y is 0 to 10; and a diol represented by the following Formula (B):

(B)

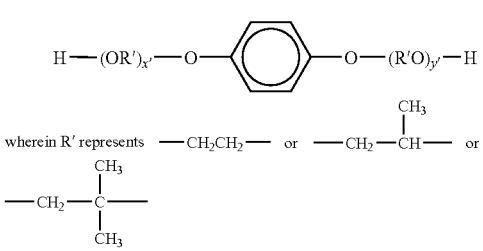

X' and y' are each an integer of 0 or more, and an average value of x'+y' is 0 to 10.

As a dibasic acid, it may include the following: Benzenedicarboxylic acids or anhydrides thereof, such as phthalic acid, terephthalic acid, isophthalic acid and phthalic anhydride, or lower alkyl esters thereof; alkyldicarboxylic acids such as succinic acid, adipic acid, sebacic acid and azelaic acid, or anhydrides or lower alkyl esters thereof; alkenylsuccinic acids or alkylsuccinic acids, such as n-dodecenylsuccinic acid and n-dodecylsuccinic acid, or anhydrides or lower alkyl esters thereof.

In particular, for a low-viscous saturated polyester resin, it is preferable to use as an acid monomer a dicarboxylic acid or an anhydride thereof, such as an alkenyl succinic acid or an alkyl succinic acid, or an anhydride or lower alkyl ester thereof. Such an acid monomer makes the low-viscous saturated polyester resin readily adaptable to the hybrid resin, and hence makes the low-viscous saturated polyester resin readily enter the gel component made up of the hybrid resin.

As an acid component having an unsaturated bond, for obtaining the unsaturated polyester resin, preferably usable are unsaturated dicarboxylic acids such as fumaric acid, maleic acid, citraconic acid and itaconic acid, or anhydrides or lower alkyl esters thereof.

Any of these unsaturated dicarboxylic acids may be used in a proportion of from 0.1 mole % to 10 mole %, preferably from 0.3 mole % to 5 mole %, and more preferably from 0.5 mole % to 3 mole %, based on the whole acid component of the polyester monomer. Where the unsaturated dicarboxylic acid is added in an amount within the above range, unsaturated bonds held in low-molecular weight polyester molecules can be in a suitable concentration and can have an appropriate distance between cross-linking points to effect hybridization of the polyester resin with the vinyl resin.

A trihydric or higher alcohol component and a tribasic or higher acid component may also optionally be used.

The trihydric or higher, polyhydric alcohol component may include the following: Sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polybasic carboxylic acid component may include the following: Polybasic carboxylic acids and derivatives thereof, such as pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, Empol trimer acid, and anhydrides or lower alkyl esters of these; and a tetracarboxylic acid represented by the following

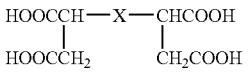

(wherein X represents an alkylene group or alkenylene group having 5 to 30 carbon atoms which has at least one side chain having 3 or more carbon atoms), and anhydrides or lower alkyl esters thereof. In particular, preferred are 1,2,4-benzenetricarboxylic acid, 1,2,5-benzenetricarboxylic acid and anhydrides or lower alkyl esters of these.

In the polyester resin, the alcohol component may be in a proportion of from 40 mole % to 60 mole %, and preferably from 45 mole % to 55 mol %; and the acid component, from 60 mole % to 40 mole %, and preferably from 55 mole % to 45 mole %. Where the trihydric or -basic or higher component is used, it may preferably be in a proportion of from 0.1 to 60 mole %, and more preferably from 0.1 mole % to 20 mole %, of the whole components.

The polyester resin is usually obtained by commonly known condensation polymerization. The polymerization reaction for the polyester resin is usually carried out in the presence of a catalyst and under a temperature condition of approximately from 150° C. to 300° C., and preferably from 170° C. to 280° C. The reaction may also be carried out under normal pressure, under reduced pressure or under some pressure. After the reaction has reached a stated conversion (e.g., approximately from 30% to 90%), it may preferably be carried out setting the reaction system under a reduced pressure of 200 mmHg or less, preferably 25 mmHg or less, and more preferably 10 mmHg or less.

As the catalyst, it may include catalysts used usually in polyesterification, which are the following: Metals such as tin, titanium, antimony, manganese, nickel, zinc, lead, iron, magnesium, calcium and germanium; and compounds containing any of these metals, such as dibutyltin oxide, orthodibutyl titanate, tetrabutyl titanate, tetraisopropyl titanate, zinc acetate, lead acetate, cobalt acetate, sodium acetate and antimony trioxide.

In the present invention, a titanium compound may preferably be used in view of readiness to control polymerization reaction and highness in its reactivity with the vinyl monomer. As particularly preferred ones, it may include tetraisopropyl titanate and dipotassium titanyl oxalate. Here, it is particularly preferable to add an antioxidant (in particular, a phosphorus type antioxidant) as a coloring preventive for the binder resin, and a co-catalyst (a magnesium compound is preferred, and, in particular, magnesium acetate is preferred) as a reaction accelerator.

The reaction may be terminated at the time the properties (e.g., an acid value and a softening point) of a reaction product have come to the stated values or at the time the stirring torque or stirring power of a reaction machine have come to the stated values, thus the polyester resin in the present invention can be obtained.

In the present invention, the vinyl polymer means a vinyl homopolymer or vinyl copolymer.

The monomer for obtaining the vinyl resin may include the following: Styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene and isoprene; vinyl halides such as vinyl chloride, vinyl bromide and vinyl fluoride; vinyl esters such as vinyl acetate, vinyl propionate and vinyl benzoate; α-methylene aliphatic monocarboxylic esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide. Any of these vinyl monomers may be used alone or in the form of a mixture of two or more monomers.

Of these, monomers may preferably be used in such a combination that may give a styrene copolymer and a styrene-acrylic copolymer.

Further, monomers which control the acid value of the binder resin may include the following: Acrylic acids and α- or β-alkyl derivatives thereof, such as acrylic acid, methacrylic acid, α-ethylacrylic acid and crotonic acid; and unsaturated dicarboxylic acids such as fumaric acid, maleic acid and citraconic acid, and monoester derivatives of these, or maleic anhydride. Any of these monomers may be used alone or in the form of a mixture, and may be copolymerized with other monomer to obtain the desired binder resin. Of these, it is particularly preferable to use monoester derivatives of unsaturated dicarboxylic acids, in order to control the acid value.

Stated more specifically, they may include the following: Monoesters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; monoesters of alkyenyldicarboxylic acids, such as monobutyl n-butenyl succinate, monomethyl n-octenyl succinate, monoethyl n-butenyl succinate, monomethyl n-dodecenyl glutarate, and monobutyl n-butenyl adipate; and monoesters of aromatic dicarboxylic acids, such as monomethyl phthalate, monoethyl phthalate and monobutyl phthalate.

The carboxyl-group-containing monomer as described above may preferably be used in an amount of from 0.1% by mass to 30% by mass based on the mass of all monomers used when the vinyl polymer unit is synthesized.

The vinyl polymer unit contained in the gel component in the present invention may preferably be one having a high chain linearity, and hence it may more preferably be one not containing any cross-linkable monomer. In order to achieve what is aimed in the present invention, a cross-linkable monomer as exemplified below may also be added.

As the cross-linkable monomer, a monomer having two or more polymerizable double bonds may chiefly be used, which may include the following: Aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene (4)-2,2-bis(4-hydroxyphenyl)propane diacrylate, and the above compounds whose acrylate moiety has been replaced with methacrylate; and polyester type diacrylate compounds as exemplified by MANDA (trade name; available from Nippon Kayaku Co., Ltd.). As a polyfunctional cross-linkable monomer, it may include the following: Pentaerythritol acrylate, trimethylolethane triacrylate, trimethylolpropane triacrylate, tetramethylolpropane triacrylate, tetramethylolmethane tetraacrylate, oligoester acrylate, and the above compounds whose acrylate moiety has been replaced with methacrylate; triallylcyanurate, and triallyltrimellitate.

Any of these cross-linkable monomers may preferably be used in an amount of from 0.001 part by mass to 1 part by mass, and preferably from 0.001 part by mass to 0.05 part by mass, based on 100 parts by mass of other vinyl monomer components.

The vinyl resin may preferably be produced using a polyfunctional polymerization initiator alone or using a polyfunctional polymerization initiator and a monofunctional polymerization initiator in combination, which are as exemplified below.

As specific examples of a polyfunctional polymerization initiator having a polyfunctional structure, it may include the following: Polyfunctional polymerization initiators having in one molecule two or more functional groups such as peroxide groups, having a polymerization initiating function, such as 1,1-di-t-butylperoxy-3,3,5-trimethylcyclohexane, 1,1-di-t-hexylperoxy-3,3,5-trimethylcyclohexane, 1,1-di-t-amylperoxy-3,3,5-trimethylcyclohexane, 1,1-di-t-butylperoxy-2-methylcyclohexane, 1,3-bis(butylperoxyisopropyl)benzene, 1,3-bis(neodecanolperoxyisopropyl)benzene, 2,5-dimethyl-2,5-di-(t-butylperoxy)hexane, 2,5-dimethyl-2,5-di-(t-butylperoxy)hexyne-3,2,5-dimethyl-2,5-di-(2-ethylhexanolperoxy)hexane, 2,5-dimethyl-2,5-di-(m-toluolperoxy)hexane, 2,5-dimethyl-2,5-di-(benzoylperoxy)hexane, tris-(t-butylperoxy)triazine, 1,1-di-t-butylperoxycyclohexane, 1,1-di-t-hexylperoxycyclohexane, 1,1-di-t-amylperoxycyclohexane, 1,1-di-t-butylperoxycyclododecane, 2,2-di-t-butylperoxybutane, 4,4-di-t-butylperoxyvaleric acid-n-butyl ester, di-t-butyl peroxyhexahydroterephthalate, di-t-butyl peroxyhexahydroisophthalate, di-t-butyl peroxyazelate, di-t-butyl peroxytrimethyladipate, 2,2-bis(4,4-di-t-butylperoxycyclohexyl)propane, 2,2-di-t-butylperoxyoctane, and various polymer oxides; and polyfunctional polymerization initiators having in one molecule both a functional group such as a peroxide group, having a polymerization initiating function, and a polymerizable unsaturated group, such as diallyl peroxydicarbonate, t-butyl peroxymaleate, t-butyl peroxyallylcarbonate, and t-butyl peroxyisopropylfumarate.

Of these, the following may include as more preferred ones: 1,3-Bis(t-butylperoxyisopropyl)benzene, 2,5-dimethyl-2,5-di-(t-butylperoxy)hexane, 2,5-dimethyl-2,5-di-(t-butylperoxy)hexyne-3, and 2,2-bis(4,4-di-t-butylperoxycyclohexyl)propane.

Any of these polyfunctional polymerization initiators may preferably be used in an amount of from 0.01 part by mass to 10 parts by mass based on 100 parts by mass of the monomer, in view of efficiency.

Further, in the case when any of these polyfunctional polymerization initiators is used in combination with a monofunctional polymerization initiator, it may preferably be used in combination with a monofunctional polymerization initiator whose temperature at which its half-life comes to be 10 hours (i.e., 10-hour half-life temperature) is lower than that of the polyfunctional polymerization initiator.

Such a monofunctional polymerization initiator may specifically include the following:

Organic peroxides such as benzoyl peroxide, n-butyl-4,4-di(t-butylperoxy)valerate, dicumyl peroxide, α,α'-bis(t-butylperoxydiisopropyl)benzene, t-butylperoxycumene, and di-t-butyl peroxide; and azo or diazo compounds such as azobisisobutylonitrile and diazoaminoazobenzene.

Any of these monofunctional polymerization initiators may be added to the monomer at the same time the polyfunctional polymerization initiator is added. In order to keep a proper efficiency of the polyfunctional polymerization initiator, the monofunctional polymerization initiator may preferably be added after the polymerization conversion of the vinyl monomer has reached 50% or more in the polymerization step.

It is preferable for the binder resin according to the present invention that, as described above, the hybrid resin is obtained by bulk polymerization, in which the vinyl monomer is polymerized without use of any solvent, in the presence of such an unsaturated polyester resin as that described above. In particular, it is preferable that one having a 10-hour half-life temperature of 100° C. to 150° C. is used as the polymerization initiator and the polymerization reaction is carried out until the polymerization conversion of the vinyl monomer reaches 60%, and preferably 80%, within the range of from a temperature lower by 30° C. than the 10-hour half-life temperature of the polymerization initiator and a temperature higher by 10° C. than the 10-hour half-life temperature to enlarge the molecular weight of the vinyl polymer unit to be produced by the bulk polymerization. Further, it is preferable that, after the polymerization conversion has reached 60%, preferably 80%, the polymerization reaction is carried out at a temperature higher by 10° C. than the 10-hour half-life temperature, where the reaction is completed.

As the binder resin in the present invention, it is most preferable to use the hybrid resin, but a polyester resin may also preferably be used which is obtained by polymerizing a monomer(s) which can make up the above polyester unit. A vinyl polymer may still also be used which is obtained by polymerizing the above vinyl monomer.

The binder resin thus obtained may have an acid value of from 0.1 mgKOH/g to 50 mgKOH/g, preferably from 1 mgKOH/g to 40 mgKOH/g, and more preferably from 1 mgKOH/g to 30 mgKOH/g, and a hydroxyl value ranging from 5 mgKOH/g to 80 mgKOH/g, preferably from 5 mgKOH/g to 60 mgKOH/g, and more preferably from 10 mgKOH/g to 50 mgKOH/g. This is preferable in order to stabilize the triboelectric chargeability of the toner.

Further, the binder resin used in the present invention may contain tetrahydrofuran-insoluble matter in an amount of from 5% by mass to 50% by mass, preferably from 5% by mass to 40% by mass, and more preferably from 10% by mass to 30% by mass. This is preferable in order to improve the developing performance and high-temperature anti-offsetting properties of the toner.

The binder resin used in the present invention may have a softening point of from 100° C. to 150° C., and preferably from 100° C. to 140° C. This is preferable in order to balance the low-temperature fixing performance with the high-temperature anti-offsetting properties. If it has a softening point of less than 100° C., the toner may have low high-temperature anti-offsetting properties. If it has a softening point of more than 150° C., the toner may have a low low-temperature fixing performance.

The binder resin used in the present invention may have a glass transition temperature (Tg) of from 50° C. to 75° C. If the binder resin has a glass transition temperature of less than 50° C., the toner may have an insufficient storage stability. If it has a glass transition temperature of more than 75° C., the toner may have an insufficient low-temperature fixing performance.

The toner of the present invention may further be incorporated with a magnetic material (e.g., a magnetic iron oxide) so that it may be used as a magnetic toner. In this case, the magnetic material may also serve as a colorant.

In the present invention, the magnetic material to be contained in the magnetic toner may include the following: Iron oxides such as magnetite, maghemite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may preferably be those having an average particle diameter of 2.0 μm or less, and preferably from 0.05 μm to 0.5 μm. The magnetic material may preferably be incorporated in the toner in an amount of from 20 parts by mass to 200 parts by mass based on 100 parts by mass of the binder resin, and particularly preferably from 40 parts by mass to 150 parts by mass based on 100 parts by mass of the resin component.

As the colorant used in the present invention, carbon black, grafted carbon, and a colorant toned in black by the use of yellow, magenta and cyan colorants shown below may be used as black colorants.

As yellow colorants, compounds typified by condensation azo compounds, isoindolinone compounds, anthraquinone compounds, azo metal complexes, methine compounds and allylamide compounds are used.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used.

As cyan colorants, copper phthalocyanine compounds and derivatives thereof, anthraquinone compounds and basic dye lake compounds may be used.

Any of these colorants may be used alone, in the form of a mixture, or in the state of a solid solution.

Non-magnetic colorants used in the present invention are selected taking account of hue angle, chroma, brightness, weatherability, transparency on OHP films and dispersibility in toner particles. The non-magnetic colorant may be used in an amount of from 1 part by mass to 20 parts by mass based on 100 parts by mass of the binder resin.

The toner of the present invention may preferably be incorporated with a charge control agent, and may particularly preferably be used as a negatively chargeable toner. A charge control agent capable of controlling the toner to be negatively chargeable includes the following materials.

Organic metal complex salts and chelate compounds are effective, including monoazo metal complexes, acetylyacetone metal complexes, aromatic hydroxycarboxylic acid and aromatic dicarboxylic acid type metal complexes. Besides, they also include polymers, or copolymers, having a sulfonic acid group, a sulfonic acid base group or a sulfonate group; aromatic hydroxycarboxylic acids, aromatic mono- and polycarboxylic acids, and metal salts, anhydrides or esters thereof; and phenol derivatives such as bisphenol.

As a negatively charging charge control agent, it may preferably be an azo type metal compound represented by the formula (1) shown below or an oxycarboxylic acid compound represented by the formula (2) shown below.

(1)

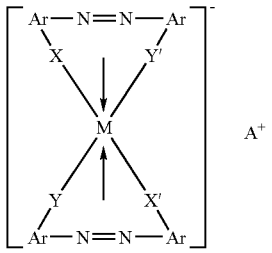

In the formula, M represents a central metal, which represents Sc, Ti, V, Cr, Co, Ni, Mn or Fe, Ar is an aryl group, representing a phenylene group or a naphthylene group, which may have a substituent. The substituent in this case includes a nitro group, a halogen atom, a carboxyl group, an anilide group, and an alkyl group or alkoxyl group having 1 to 18 carbon atoms. X, X', Y and Y' are each —O—, —CO—, —NH— or —NR— (R is an alkyl group having 1 to 4 carbon atoms). $A^+$ represents a hydrogen ion, a sodium ion, a potassium ion, an ammonium or an aliphatic ammonium ion, or a mixture of any of these, provided that $A^+$ is not present in some cases.

In particular, as the central metal, Fe is preferred. As the substituent, a halogen atom, an alkyl group or an anilide group is preferred.

(2)

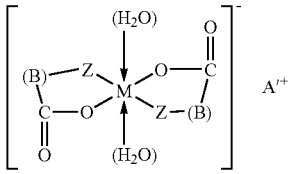

In the formula, M represents a central metal of coordination, which may include Cr, Co, Ni, Mn, Fe, Zn, Al, Si or B (boron).

Letter symbol B represents

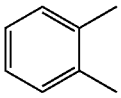

(which may have a substituent such as an alkyl group)

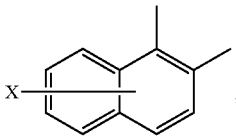

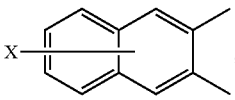

-continued

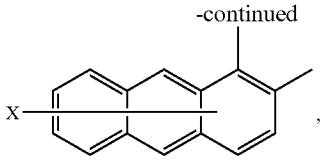

(X represents a hydrogen atom, a halogen atom, a nitro group or an alkyl group)

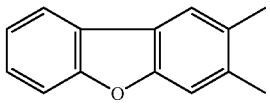

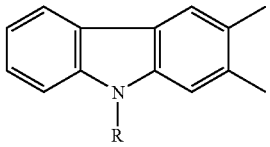

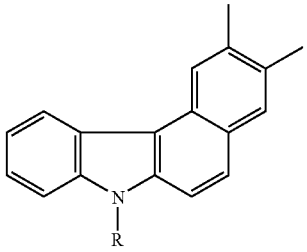

(R represents a hydrogen atom, an alkyl group having 1 to 18 carbon atoms or an alkenyl group having 2 to 18 carbon atoms)

$A'^+$ represents hydrogen, sodium, potassium, ammonium, aliphatic ammonium ion or nothing.

Z is —O—; or —C(=O)—O—

In particular, as the central metal, Fe, Si, Zn, Zr or Al is preferred. As the substituent, an alkyl group, an anilide group, an aryl group or a halogen atom is preferred. As the counter ion, an ammonium ion or an aliphatic ammonium ion is preferred.

Of these, the azo type metal compound represented by the formula (1) is more preferred. In particular, an azo type iron compound represented by the following formula (3) is most preferred.

(3)

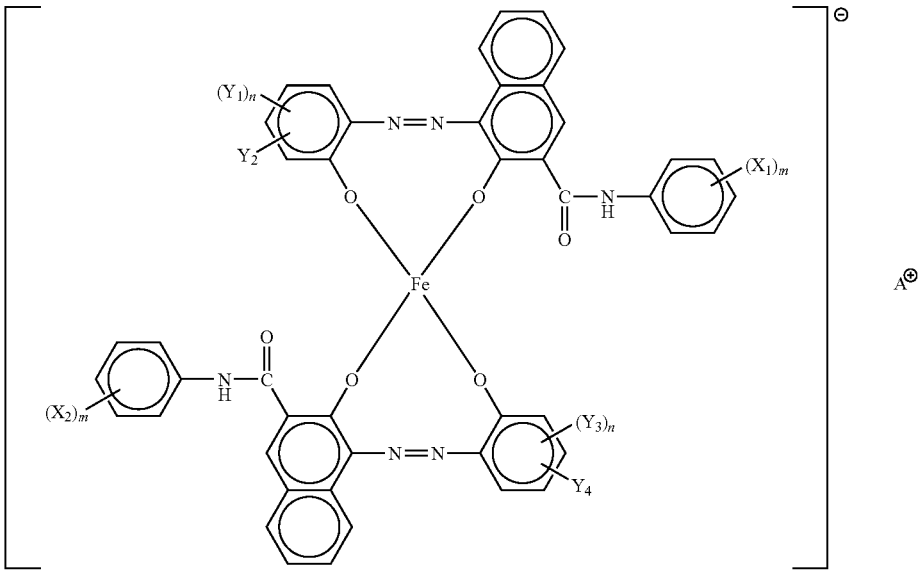

In the formula, $X_1$ and $X_2$ each represent a hydrogen atom, a lower alkyl group, a lower alkoxyl group, a nitro group or a halogen atom, and m and m' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic acid group, a carboxylic ester group, a hydroxyl group, an alkoxyl group having 1 to 18 carbon atoms, an acetylamino group, a benzoyl group, an amino group or a halogen atom; n and n' each represent an integer of 1 to 3; and $Y_2$ and $Y_4$ each represent a hydrogen atom or a nitro group; (the above $X_1$ and $X_2$, m and m', $Y_1$ and $Y_3$, n and n', and $Y_2$ and $Y_4$ may be the same or different); and $A^+$ represents an ammonium ion, an alkali metal ion, a hydrogen ion or a mixed ion of any of these.

Specific examples of the compound are shown below.

Azo type iron compound (1)

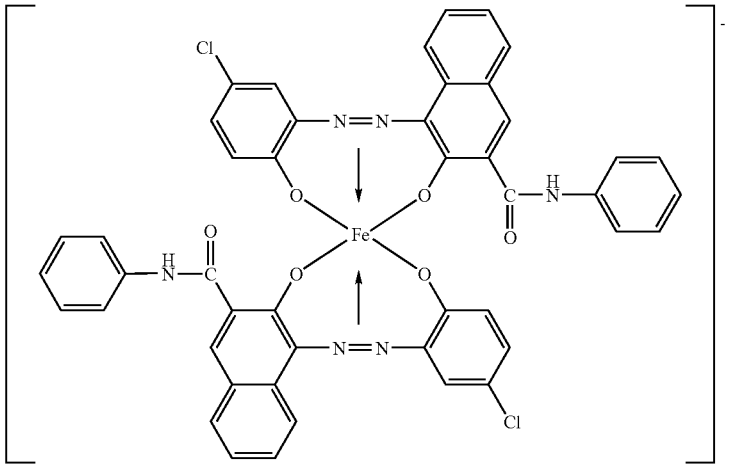

$NNH_4^+$ (or $H^+$, $Na^+$, $K^+$ or a mixed ion of any of these)

-continued
Azo type iron compound (2)
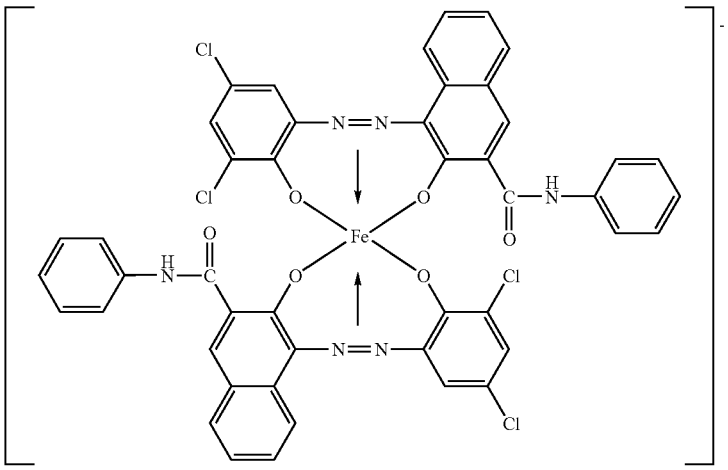
$NNH_4^+$ (or $H^+$, $Na^+$, $K^+$ or a mixed ion of any of these)
Azo type iron compound (3)
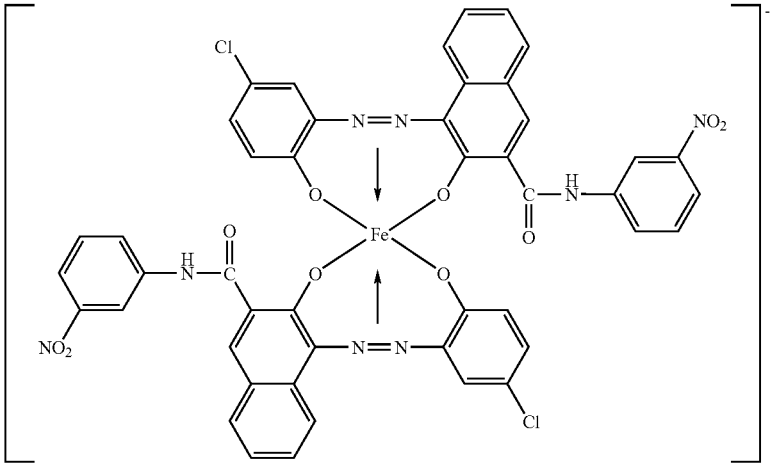
$NNH_4^+$ (or $H^+$, $Na^+$, $K^+$ or a mixed ion of any of these)
Azo type iron compound (4)
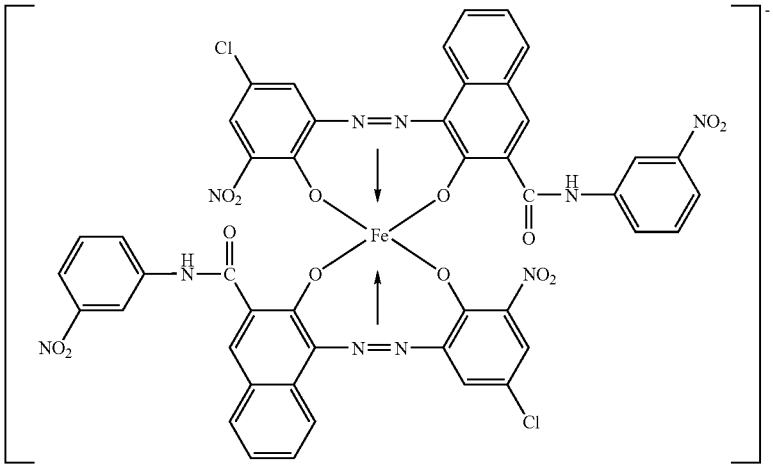
$NNH_4^+$ (or $H^+$, $Na^+$, $K^+$ or a mixed ion of any of these)

-continued

Azo type iron compound (5)

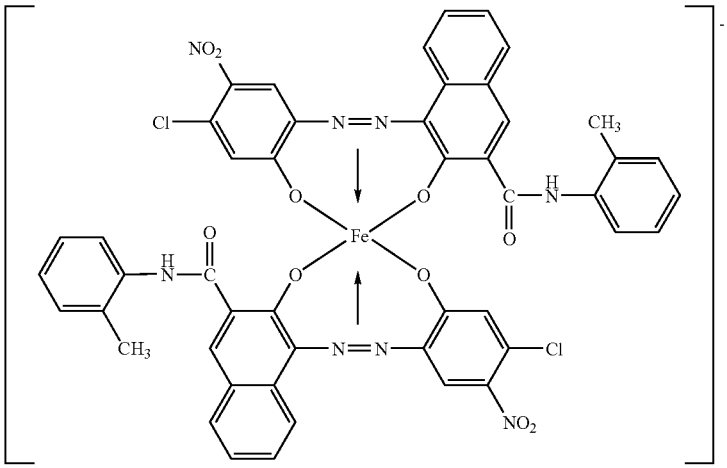

$NNH_4^+$ (or $H^+$, $Na^+$, $K^+$ or a mixed ion of any of these)

Azo type iron compound (6)

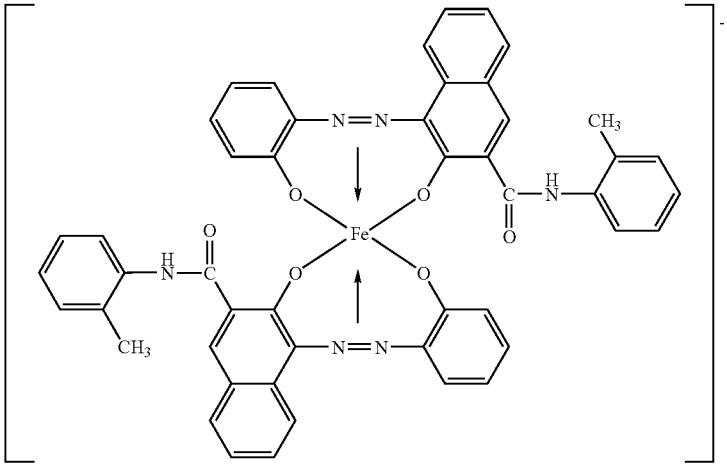

$NNH_4^+$ (or $H^+$, $Na^+$, $K^+$ or a mixed ion of any of these)

The toner of the present invention may also be used as a positively chargeable toner. As a positively chargeable charge control agent, it may be exemplified by the following materials: Nigrosine and products modified with a fatty acid metal salt; quaternary ammonium salts such as tributylbenzylammonium 1-hydroxy-4-naphthosulfonate and tetrabutylammonium teterafluoroborate; onium salts such as a phosphonium salt, and lake pigments of these (lake-forming agents include tungstophosphoric acid, molybdophosphoric acid, tungstomolybdophosphoric acid, tannic acid, lauric acid, gallic acid, ferricyanic acid and ferrocyanic acid); metal salts of higher fatty acids; guanidine compounds, and imidazole compounds. Any of these may be used alone or in combination of two or more types. Of these, triphenylmethane compounds, and quaternary ammonium salts whose counter ions are not halogens may preferably be used.

Homopolymers of monomers represented by the following formula (4):

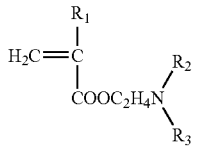

(4)

wherein $R_1$ represents a hydrogen atom or a methyl group; $R_2$ and $R_3$ each represent a substituted or unsubstituted alkyl group (preferably having 1 to 4 carbon atoms); or copolymers of polymerizable monomers such as styrene, acrylates or methacrylates as described above may also be used as positive charge control agents. In this case, these charge control agents may also act as binder resins (as a whole or in part).

In particular, a compound represented by the following formula (5) is preferred in the constitution of the present invention.

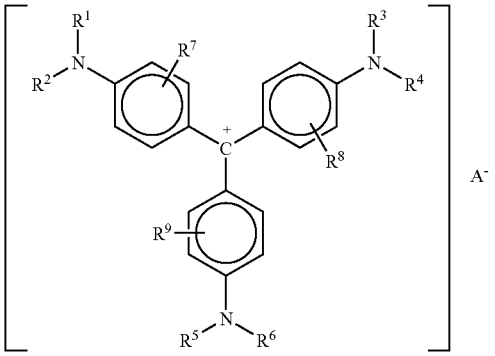

(5)

In the formula, $R^1$, $R^2$, $R^3$, $R^4$, $R^5$ and $R^6$ may be the same or different from one another and each represent a hydrogen atom, a substituted or unsubstituted alkyl group or a substituted or unsubstituted aryl group; $R^7$, $R^8$ and $R^9$ may be the same or different from one another and each represent a hydrogen atom, a halogen atom, an alkyl group or an alkoxyl group; and $A^-$ represents a negative ion selected from a sulfate ion, a nitrate ion, a borate ion, a phosphate ion, a hydroxide ion, an organic sulfate ion, an organic sulfonate ion, an organic phosphate ion, a carboxylate ion, an organic borate ion, and tetrafluorborate.

Those preferable as agents for negative charging may include the following: Spilon Black TRH, T-77, T-95 (available from Hodogaya Chemical Co., Ltd.); and BONTRON (registered trademark) S-34, S-44, S-54, E-84, E-88, E-89 (available from Orient Chemical Industries Ltd.). Those preferable as agents for positive charging may include the following: TP-302, TP-415 (available from Hodogaya Chemical Co., Ltd.); BONTRON (registered trademark) N-01, N-04, N-07, P-51 (available from Orient Chemical Industries Ltd.); and Copy Blue PR (available from Klariant GmbH).

As methods for incorporating the toner with the charge control agent, available are a method of adding it internally to toner particles and a method of adding it externally to toner particles. The amount of the charge control agent to be used depends on the type of the binder resin, the presence or absence of any other additives, and the manner by which the toner is produced, including the manner of dispersion, and can not absolutely be specified. Preferably, the charge control agent may be used in an amount ranging from 0.1 part by mass to 10 parts by mass, and more preferably from 0.1 part by mass to 5 parts by mass, based on 100 parts by mass of the binder resin.

To the toner of the present invention, a fluidity improver may externally be added. The fluidity improver is an agent which can improve the fluidity of the toner by its external addition to toner particles, as seen in comparison before and after its addition. Such a fluidity improver may include the following: Fluorine resin powders such as fine vinylidene fluoride powder and fine polytetrafluoroethylene powder; fine silica powders such as wet-process silica and dry-process silica, fine titanium oxide powders and fine alumina powder, and treated fine powders obtained by subjecting these fine powders to surface treatment with a silane coupling agent, a titanium coupling agent or a silicone oil; oxides such as zinc oxide and tin oxide; double oxides such as strontium titanate, barium titanate, calcium titanate, strontium zirconate and calcium zirconate; and carbonate compounds such as calcium carbonate and magnesium carbonate.

A preferred fluidity improver is fine powder produced by vapor phase oxidation of a silicon halide, which is called dry-process silica or fumed silica. For example, it utilizes heat decomposition oxidation reaction in oxyhydrogen frame of silicon tetrachloride gas. The reaction basically proceeds as follows.

$$SiCl_4+2H_2+O_2 \rightarrow SiO_2+4HCl$$

In this production step, it is also possible to use other metal halide such as aluminum chloride or titanium chloride together with the silicon halide to obtain a composite fine powder of silica with other metal oxide, and the silica includes these as well. As to its particle diameter, it is preferable to use fine silica powder having an average primary particle diameter within the range of from 0.001 μm to 2 μm, and particularly preferably within the range of from 0.002 μm to 0.2 μm.

Commercially available fine silica powders produced by the vapor phase oxidation of silicon halides may include the following: AEROSIL 130, 200, 300, 380, TT600, MOX170, MOX80, and COK84 (Aerosil Japan, Ltd.); Ca-O-SiL M-5, MS-7, MS-75, HS-5, and EH-5 (CABOT Co.); Wacker HDK N20, V15, N20E, T30, and T40 (WACKER-CHEMIE GMBH); D-C Fine Silica (Dow-Corning Corp.); and Fransol (Franzil Co.). These may also preferably be used in the present invention.

Further, as the fluidity improver usable in the present invention, a treated fine silica powder is more preferred which is obtained by making hydrophobic the above fine silica powder produced by vapor phase oxidation of a silicon halide. In the treated fine silica powder, a fine silica powder is particularly preferred which has been so treated that its hydrophobicity as measured by a methanol titration test shows a value within the range of from 30 to 80.

As methods for making hydrophobic, a method is available in which the fine silica powder is made hydrophobic by chemical treatment with an organosilicon compound capable of reacting with or physically adsorbing the fine silica powder. As a preferable method, the fine silica powder produced by vapor phase oxidation of a silicon halide may be treated with an organosilicon compound.

The organosilicon compound may include hexamethyldisilazane, trimethylsilane, trimethylethoxysilane, dimethylethoxysilane, dimethyldimethoxysilane and diphenyldiethoxysilane. It may further include silicone oils such as dimethylsilicone oil. Any of these may be used alone or in the Form of a mixture of two or more types.

The fluidity improver may preferably be one having a specific surface area of 30 $m^2/g$ or more, and preferably 50 $m^2/g$ or more, as measured by the BET method utilizing nitrogen absorption. The fluidity improver may preferably be used in an amount of from 0.01 part by mass to 8 parts by mass, and preferably from 0.1 part by mass to 4 parts by mass, based on 100 parts by mass of the toner particles to which it has not externally been added.

Besides the above fluidity improver, the magnetic toner of the present invention may also be used after any known other external additive (e.g., a charge control agent) has optionally been added thereto.

The toner of the present invention may be used as a one-component developer, or may be mixed with a carrier so as to be used as a two-component developer. As the carrier used in the two-component developer, any conventionally known carrier may all be used. Stated specifically, preferably usable are metals such as iron, nickel, cobalt, manganese, chromium and rare earth elements, and alloys or oxides thereof, having been surface-oxidized or unoxidized, and having an average particle diameter of from 20 μm to 300 μm.

Also preferably usable are a carrier on the particle surfaces of which a resin such as a styrene resin, an acrylic resin, a silicone resin, a fluorine resin or a polyester resin has been deposited or coated.

To produce the toner of the present invention, the binder resin and the colorant, and optionally the magnetic material, the wax, the charge control agent and other additives may be well mixed by means of a mixing machine such as Henschel mixer or a ball mill, then the resultant mixture may be melt-kneaded by means of a heat kneading machine such as a roll, a kneader or an extruder to disperse the wax and magnetic material in the binder resin, and the kneaded product is cooled to solidity, followed by pulverization and then classification to obtain the toner.

The toner of the present invention may be produced by using any known production apparatus. The following production apparatus may be used, for example.

As a mixing machine, it may include the following: Henschel Mixer (manufactured by Mitsui Mining & Smelting Co., Ltd.); Super Mixer (manufactured by Kawata MFG Co., Ltd.); Conical Ribbon Mixer (manufactured by Y. K. Ohkawara Seisakusho); Nauta Mixer, Turbulizer, and Cyclomix (manufactured by Hosokawa Micron Corporation); Spiral Pin Mixer (manufactured by Pacific Machinery & Engineering Co., Ltd.); and Rhedige Mixer (manufactured by Matsubo Corporation).

As a kneading machine, it may include the following: KRC Kneader (manufactured by Kurimoto, Ltd.); Buss-Kneader (manufactured by Coperion Buss Ag.); TEM-type Extruder (manufactured by Toshiba Machine Co., Ltd.); TEX Twin-screw Extruder (manufactured by The Japan Steel Works, Ltd.); PCM Kneader (manufactured by Ikegai Corp.); Three-Roll Mill, Mixing Roll Mill, and Kneader (manufactured by Inoue Manufacturing Co., Ltd.); Kneadex (manufactured by Mitsui Mining & Smelting Co., Ltd.); MS-type Pressure Kneader, and Kneader-Ruder (manufactured by Moriyama Manufacturing Co., Ltd.); and Banbury Mixer (manufactured by Kobe Steel, Ltd.).

As a grinding machine, it may include the following: Counter Jet Mill, Micron Jet, and Inomizer (manufactured by Hosokawa Micron Corporation); IDS-type Mill, and PJM Jet Grinding Mill (manufactured by Nippon Pneumatic MFG Co., Ltd.); Cross Jet Mill (manufactured by Kurimoto, Ltd.); Ulmax (manufactured by Nisso Engineering Co., Ltd.); SK Jet O-Mill (manufactured by Seishin Enterprise Co., Ltd.); Criptron (manufactured by Kawasaki Heavy Industries, Ltd); Turbo Mill (manufactured by Turbo Kogyo Co., Ltd.); and Super Rotor (manufactured by Nisshin Engineering Inc.).

As a classifier, it may include the following: Classyl, Micron Classifier, and Spedic Classifier (manufactured by Seishin Enterprise Co., Ltd.); Turbo Classifier (manufactured by Nisshin Engineering Inc.); Micron Separator, Turboprex (ATP), and TSP Separator (manufactured by Hosokawa Micron Corporation); Elbow Jet (manufactured by Nittetsu Mining Co., Ltd.); Dispersion Separator (manufactured by Nippon Pneumatic MFG Co., Ltd.); and YM Microcut (manufactured by Yasukawa Shoji K.K.).

As a sifter used to sieve coarse powder, it may include the following: Ultrasonics (manufactured by Koei Sangyo Co., Ltd.); Rezona Sieve, and Gyro Sifter (manufactured by Tokuju Corporation); Vibrasonic Sifter (manufactured by Dulton Company Limited); Sonicreen (manufactured by Shinto Kogyo K.K.); Turbo-Screener (manufactured by Turbo Kogyo Co., Ltd.); Microsifter (manufactured by Makino mfg. co., ltd.); and circular vibrating screens.

Measurement of various physical properties concerning the toner of the present invention is described below. In the present invention, the molecular weight distribution of tetrahydrofuran-soluble matter of the toner and binder resin, and the tetrahydrofuran-insoluble matter content and softening point thereof may be measured by methods shown below.

(1) Measurement of Molecular Weight of Tetrahydrofuran-Soluble Matter

First, the toner is dissolved in tetrahydrofuran (THF) at room temperature over a period of 24 hours. Then, the solution obtained is filtered with a solvent-resistant membrane filter "MAISHORIDISK" (available from Tosoh Corporation) of 0.2 μm in pore diameter to make up a sample solution. Here, the sample solution is so adjusted that the component soluble in THF is in a concentration of about 0.8% by mass. Using this sample solution, the measurement is made under the following conditions.

Instrument: HLC8120 GPC (detector: RI) (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: Tetrahydrofuran (THF).

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (e.g., trade name "TSK Standard Polystyrene F-850, F-450, F-288, F-128, F-80, F-40, F-20, F-10, F-4, F-2, F-1, A-5000, A-2500, A-1000, A-500"; available from Tosoh Corporation).

(2) Tetrahydrofuran-Insoluble Matter Content

The tetrahydrofuran-insoluble matter content of the resin component in the binder resin or toner is measured in the following way.

About 1.0 g of the binder resin or toner is weighed (W1 g), which is then put in a cylindrical filter paper (e.g., trade name: No. 86R, 28 mm×100 mm in size, available from Advantec MFS, Inc.) weighed previously, and this is set on a Soxhlet extractor. Then, extraction is carried out for 16 hours using 200 ml of tetrahydrofuran (THF) as a solvent. At this point, the extraction is carried out at such a reflux speed that the extraction cycle of the solvent is one time per about 5 minutes.

After the extraction has been completed, the cylindrical filter paper is taken out and air-dried, and thereafter vacuum-dried at 40° C. for 8 hours to measure the mass of the cylindrical filter containing extraction residues, where the mass (W2 g) of the extraction residues is calculate by subtracting the mass of the cylindrical filter.

Then, the content (W3 g) of components other than the resin component is subtracted as shown in the following expression (1) to determine the THF-insoluble matter content.

$$\text{THF-insoluble matter(\% by mass)}=\{(W2-W3)/(W1-W3)\}\times 100 \quad (1).$$

The content of components other than the resin component may be measured by a known analytical means. When analysis is difficult, the content of components other than the resin component [(i.e., incineration residue ash content (W3' g) in toner] may be estimated, and its content may be subtracted to determine the THF-insoluble matter content.

The incineration residue ash content is determined in the following way. About 2 g of the toner is weighed out (Wa g) in a 30 ml magnetic crucible weighed previously. The crucible is put in an electric furnace, and is heated at about 900°

C. for about 3 hours, followed by leaving to cool in the electric furnace, and then leaving to cool in a desiccator for 1 hour or more at normal temperature, where the mass of the crucible containing the incineration residue ash content is weighed, and the incineration residue ash content (Wb g) is calculate by subtracting the mass of the crucible. Then, the incineration residue ash content (W3' g) in W1 g of the sample is calculated according to the following expression (2).

$$W3'=W1\times(Wb/Wa) \quad (2).$$

In this case, the THF-insoluble matter content is determined according to the following expression (3).

$$\text{THF-insoluble matter(\% by mass)}=\{(W2-W3')/(W1-W3')\}\times 100 \quad (3)$$

(3) Measurement of Acid Value of Resin

The acid value is the number of milligrams of potassium hydroxide necessary to neutralize the acid contained in 1 g of a sample. The acid value of the binder resin is measured according to JIS K 0070-1992. Stated specifically, it is measured according to the following procedure.

(1) Preparation of Reagent 1.0 g of Phenolphthalein is dissolved in 90 ml of ethyl alcohol (95 vol. %), and ion-exchanged water is so added thereto as to add up to 100 ml to obtain a phenolphthalein solution.

7 g of Guaranteed potassium hydroxide is dissolved in 5 ml of water, and ethyl alcohol (95 vol. %) is so added thereto as to add up to 1 liter. So as not to be exposed to carbon dioxide and so forth, this solution is put into an alkali-resistant container and then left to stand for 3 days, followed by filtration to obtain a potassium hydroxide solution. The potassium hydroxide solution obtained is stored in an alkali-resistant container. For the factor of the potassium hydroxide solution, 25 ml of 0.1 mole/liter hydrochloric acid is taken into an Erlenmeyer flask, and a few drops of the phenolphthalein solution are added thereto to carry out titration with the potassium hydroxide solution, where the factor is determined from the amount of the potassium hydroxide solution required for neutralization. As the 0.1 mole/liter hydrochloric acid, one prepared according to JIS K 8001-1998 is used.

(2) Operation (A) Main Test 2.0 g of binder resin having been pulverized is precisely weighed out in a 200 ml Erlenmeyer flask, and 100 ml of a toluene-ethanol (2:1) mixed solvent is added thereto to make the former dissolve in the latter over a period of 5 hours. Next, to the solution obtained, a few drops of the phenolphthalein solution are added as an indicator to carry out titration with the above potassium hydroxide solution. Here, the end point of titration is the point of time where pale deep red of the indicator has continued for about 30 seconds.

(B) Blank Test

Titration is carried out according to the same procedure as the above except that the sample is not used (i.e., only the toluene-ethanol (2:1) mixed solvent is used).

(3) The results obtained are substituted for the following equation to calculate the acid value.

$$A=[(C-B)\times f\times 5.61]/S$$

where A is the acid value (mgKOH/g), B is the amount (ml) of the potassium hydroxide solution in the blank test, C is the amount (ml) of the potassium hydroxide solution in the main test, f is the factor of the potassium hydroxide solution, and S is the sample (g).

(4) Softening Point

The softening point in the present invention is measured with a constant-load extrusion type capillary rheometer "Fluidity Characteristics Evaluation Instrument FLOW TESTER CFT-500D" (manufacture by Shimadzu Corporation) according to a manual attached to the instrument. In this instrument, a constant load is applied from above a measuring sample by means of a piston, during which the measuring sample, which is filled in a cylinder, is melted by raising its temperature (heating). The measuring sample melted is extruded from a die provided at the bottom of the cylinder, where a flow curve showing the relationship between the level of descent of the piston and the temperature is obtainable.

In the present invention, "Melting temperature in ½ process" prescribed in the manual attached to the "Fluidity Characteristics Evaluation instrument FLOW TESTER CFT-500D" is set as the melting point. Here, the "Melting temperature in ½ process" is a value calculated in the following way. First, the value of ½ is found which is of a difference between the level of descent Smax of the piston at the point of time where the sample has completely flowed out and the level of descent Smin of the piston at the point of time where the sample has begun to flow out [this value is represented by X. X=(Smax−Smin)/2]. Then, the temperature of the flow curve at the time the level of descent of the piston comes to the sum of X and 5 min in the flow curve is the "Melting temperature in ½ process".

As the measuring sample, a cylindrical sample of about 8 mm in diameter is used which is obtained by molding 1.0 g of the toner or binder resin by compression at about 10 MPa for about 60 minutes, in an environment of 25° C. and using a tablet compressing machine (e.g., NT-100H, manufactured by NPa System Co., Ltd.).

Conditions for measurement with CFT-500D are as shown below.

Test mode: Heating method.
Starting temperature: 50° C.
Ultimate temperature: 200° C.
Measurement interval: 1.0° C.
Heating rate: 4.0° C./min.
Piston sectional area: 1.000 $cm^2$.
Testing load (piston load): 10.0 kgf (0.9807 MPa).
Preheating time: 300 seconds.
Aperture diameter of die: 1.0 mm.
Length of die: 1.0 mm.

EXAMPLES

The present invention is described below in greater detail by giving Examples. However, the embodiments of the present invention are by no means limited by these.

Wax Production Examples

Wax Production Example 1

As a raw-material substance, 1,000 g of paraffin wax was put into a cylindrical reaction vessel made of glass, and this was heated to 140° C. while blowing nitrogen gas into it in a small quantity (3 liters/minute). After 0.30 mole of a mixed catalyst of boric acid/boron anhydride=1.5 (molar ratio) was added thereto, the reaction was carried out at 170° C. for 4 hours while blowing air (21 liters/minute) and nitrogen (18 liters/minute) into the vessel. After the reaction was completed, hot water (95° C.) was added to the reaction mixture in quantities equal to each other, where the reaction mixture was decomposed to obtain Wax A.

100 g of Wax A was put into a container having a stirrer, a reflux condenser and a heating unit, and 1 liter of ethanol was added thereto as a solvent, where these were heated with stirring at the reflux temperature of the solvent to make the wax dissolve sufficiently. After making sure that the wax came dissolved in the solvent, the temperature was lowered to normal temperature to precipitate the wax. The wax having settled was collected by filtration, and the solvent was removed by distillation under reduced pressure to obtain Wax 1, having been purified.

Wax 1 had a hydroxyl value of 68.1 mgKOH/g, an ester value of 6.7 mgKOH/g, an acid value of 3.1 mgKOH/g, a peak molecular weight of 440, a content of molecular weight of 700 or more of 0.1% by mass, and a melting point of 76° C. Conditions for synthesizing Wax 1 and its physical properties are shown in Table 1.

Wax Production Example 2

Wax A obtained in Wax Production Example 1 was put through a sieve of 850 μm in mesh opening, where it was pulverized until coarse particles remaining on the sieve came to be in an amount of less than 0.1% by mass. To 100 g of Wax A thus pulverized, 1 liter of methanol was added. In the state the wax was dispersed in the methanol without dissolving therein, these were stirred at room temperature (25° C.) for 4 hours to extract the component with a molecular weight of 700 or more that was contained in the wax. The stirring was stopped, the wax having settled was collected by filtration, and the methanol was removed by distillation under reduced pressure to obtain Wax 2, having been purified. Physical properties of Wax 2 are shown in Table 1.

Wax Production Example 3

Wax B was obtained in the same way as Wax A of Wax Production Example 1 except that Fischer-Tropsch wax was used as the raw-material substance and the amount of the mixed catalyst of boric acid and boron anhydride added and the reaction time were changed. This Wax B was treated in the same way as in Wax Production Example 2 to extract the component with a molecular weight of 700 or more to obtain Wax 3, having been purified. Conditions for producing Wax 3 and its physical properties are shown in Table 1.

Wax Production Example 4

Wax 4 was obtained in the same way as in Production Example 3 except that the amount of the mixed catalyst of boric acid and boron anhydride added and the reaction time were changed. Conditions for producing Wax 4 and its physical properties are shown in Table 1.

Wax Production Example 5

Wax 5 was obtained in the same way as in Wax Production Example 3 except that polyethylene wax was used as the raw-material substance, the amount of the mixed catalyst of boric acid and boron anhydride added and the reaction time were changed and methyl ethyl ketone was used to extract the component with a molecular weight of 700 or more that was contained in the wax. Conditions for producing Wax 5 and its physical properties are shown in Table 1.

Wax Production Example 6

Wax 6 was obtained in the same way as in Wax Production Example 5 except that the amount of the mixed catalyst of boric acid and boron anhydride added and the reaction time were changed and toluene was used to extract the component with a molecular weight of 700 or more that was contained in the wax. Conditions for producing Wax 6 and its physical properties are shown in Table 1.

Wax Production Example 7

Wax 7 was obtained in the same way as in Wax Production Example 5 except that the amount of the mixed catalyst of boric acid and boron anhydride added and the reaction time were changed and the component with a molecular weight of 700 or more that was contained in the wax was not extracted. Conditions for producing Wax 7 and its physical properties are shown in Table 1.

Wax Production Example 8

Wax 8 was obtained in the same way as in Wax Production Example 6 except that the component with a molecular weight of 700 or more that was contained in the wax was not extracted. Conditions for producing Wax 8 and its physical properties are shown in Table 1.

Wax Production Example 9

Wax 9 was obtained in the same way as in Wax Production Example 1 except that, in producing Wax A in Wax Production Example 1, the amount of the mixed catalyst of boric acid and boron anhydride added and the reaction time were changed and the purification with ethanol was not carried out. Conditions for producing Wax 9 and its physical properties are shown in Table 1.

Wax Production Example 10

Wax 10 was obtained in the same way as in Wax Production Example 5 except that the time of reaction using the mixed catalyst of boric acid and boron anhydride was changed and the component with a molecular weight of 700 or more that was contained in the wax was not extracted. Conditions for producing Wax 10 and its physical properties are shown in Table Wax Production Example 11

Wax 11 was obtained in the same way as in Wax Production Example 5 except that the amount of the mixed catalyst of boric acid and boron anhydride added and the reaction time were changed and the time for which the component with a molecular weight of 700 or more that was contained in the wax was shortened to 30 minutes. Conditions for producing Wax 11 and its physical properties are shown in Table 1.

TABLE 1

| | Raw-material wax | Amt. of catalyst added (part) | Reaction time (H) | Reaction temp. (° C.) | Hydroxyl value (mgKOH/g) | Ester value (mgKOH/g) | Acid value (mgKOH/g) | Peak molecular weight | Cont. of molecular weight of 700 or more (mass %) | Melting point (° C.) |
|---|---|---|---|---|---|---|---|---|---|---|
| Wax 1 | Paraffin wax | 0.3 | 4 | 170 | 68.1 | 6.7 | 3.1 | 440 | 0.1 | 76 |
| Wax 2 | Paraffin wax | 0.3 | 4 | 170 | 68.8 | 7.2 | 3.5 | 480 | 0.6 | 74 |
| Wax 3 | Fischer-Tropsch wax | 0.5 | 4 | 180 | 91.7 | 22 | 16.9 | 560 | 1.2 | 88 |
| Wax 4 | Fischer-Tropsch wax | 0.6 | 6 | 190 | 115.4 | 26.3 | 24.2 | 530 | 1.7 | 85 |
| Wax 5 | Polyethylene wax | 0.6 | 7 | 190 | 125.5 | 38.9 | 33 | 550 | 1.9 | 84 |
| Wax 6 | Polyethylene wax | 1.2 | 6 | 190 | 141.2 | 44.3 | 39.9 | 580 | 2.6 | 97 |
| Wax 7 | Polyethylene wax | 0.2 | 1 | 170 | 12.6 | 2.1 | 1.7 | 560 | 2.8 | 104 |
| Wax 8 | Polyethylene wax | 1.2 | 6 | 190 | 160.3 | 58.5 | 68.8 | 620 | 7.6 | 103 |
| Wax 9 | Paraffin wax | 0.1 | 1 | 170 | 3.2 | 0.3 | 0.1 | 510 | 2.7 | 79 |
| Wax 10 | Polyethylene wax | 0.6 | 8 | 190 | 143.9 | 52.6 | 71.3 | 590 | 5.8 | 83 |
| Wax 11 | Polyethylene wax | 1.0 | 6 | 210 | 138.0 | 66.9 | 82.7 | 680 | 2.9 | 102 |

Binder Resin Production Examples

Binder Resin Production Example 1

Polyester monomers were mixed in the following proportion.

| | |
|---|---|
| Bisphenol derivative represented by the above Formula (A) | 1.150 moles |
| (R: propylene group; average value of x + y: 2.2) | 0.420 mole |
| Terephthalic acid | |
| Isophthalic acid | 0.390 mole |
| Fumaric acid | 0.010 mole |
| Dodecenylsuccinic anhydride | 0.180 mole |

To these, 0.5% by mass of tetrabutyl titanate was added as a catalyst, and condensation polymerization was carried out at 230° C. to obtain an unsaturated linear polyester resin (main-peak molecular weight: 8,600; number average molecular weight (Mn): 3,600; Mw/Mn: 2.1; acid value: 7.1 mgKOH/g; hydroxyl value: 35.4 mgKOH/g).

75 parts by mass of this unsaturated polyester resin and, as vinyl monomers, 18 parts by mass of styrene, 6.5 parts by mass of n-butyl acrylate and 0.5 part by mass of mono-n-butyl maleate, and also as a polymerization initiator 0.08 part by mass of 2,5-dimethyl-2,5-bis(t-butylperoxy)hexyne-3 (10-hour half-life temperature: 128° C.) were mixed together. This vinyl monomer/unsaturated polyester resin mixture was polymerized at 120° C. over a period of 20 hours. Thereafter, the temperature was further raised to 150° C., and was kept for 5 hours to polymerize unreacted vinyl monomers to obtain a hybrid resin, R-1.

The hybrid resin R-1 thus obtained had, in its molecular weight distribution of tetrahydrofuran-soluble matter, a main peak at molecular weight of 8,800 and a weight average molecular weight (Mw) of 41,200, and contained 31% by mass of tetrahydrofuran-insoluble matter. It also had an acid value of 6.7 mgKOH/g, a hydroxyl value of 24.4 mgKOH/g, a glass transition temperature of 58° C. and a softening point of 121° C.

Binder Resin Production Example 2

In a four-necked flask, polyester monomers were mixed in the following proportion.

| | |
|---|---|
| Bisphenol derivative represented by the above Formula (A) | 1.150 moles |
| (R: propylene group; average value of x + y: 2.2) | 0.350 mole |
| Terephthalic acid | |
| Isophthalic acid | 0.350 mole |
| Dodecenylsuccinic anhydride | 0.200 mole |
| Trimellitic anhydride | 0.110 mole |

To the polyester monomer mixture thus obtained, 1 part by mass of dibutyltin was added as an esterifying catalyst, and condensation polymerization was carried out at a temperature raised to 230° C., to obtain a polyester resin, R-2.

The polyester resin R-2 thus obtained had, in its molecular weight distribution of tetrahydrofuran-soluble matter, a main peak at molecular weight of 6,300 and a weight average molecular weight (Mw) of 113,600, and contained 19% by mass of tetrahydrofuran-insoluble matter. It also had an acid value of 36.6 mgKOH/g, a hydroxyl value of 53.5 mgKOH/g, a glass transition temperature of 56° C. and a softening point of 114° C.

Binder Resin Production Example 3

A high-molecular weight component was produced in the following way.

| | |
|---|---|
| Styrene | 75.0 parts by mass |
| n-Butyl acrylate | 22.0 parts by mass |
| Methacrylic acid | 3.0 parts by mass |
| 2,2-Bis(4,4-di-t-butylperoxycyclohexyl)propane | 0.8 part by mass |

While stirring 200 parts by mass of xylene in a four-necked flask, the interior of the container was sufficiently displaced with nitrogen. After the temperature was raised to 120° C., the above components were dropwise added over a period of 4 hours. Under further reflux of xylene, polymerization was completed. Thus, a solution was obtained which contained a high-molecular weight component, R-3-H.

Next, a low-molecular weight component was produced in the following way.

| | |
|---|---|
| Styrene | 80.0 parts by mass |
| n-Butyl acrylate | 19.0 parts by mass |
| Methacrylic acid | 1.0 part by mass |
| Di-t-butyl peroxide | 1.5 parts by mass |

The above raw materials were dropwise added to 200 parts by mass of xylene over a period of 4 hours. Under further reflux of xylene, polymerization was completed. Thus, a solution was obtained which contained a low-molecular weight component, R-3-L.

A cross-linkable component was produced in the following way.

| | |
|---|---|
| Styrene | 79.0 parts by mass |
| n-Butyl acrylate | 20.0 parts by mass |
| Glycidyl methacrylate | 1.0 part by mass |
| Di-t-butyl peroxide | 5.0 parts by mass |

While stirring 200 parts by mass of xylene in a four-necked flask, the interior of the container was sufficiently displaced with nitrogen. After the temperature was raised to 120° C., the above components were dropwise added over a period of 4 hours. Under further reflux of xylene, polymerization was completed, and the solvent was removed by evaporation under reduced pressure. A resin component thus obtained was termed as a cross-linkable resin component, R-3-C.

The high-molecular weight component R-3-H and low-molecular weight component R-3-L obtained as above were so mixed and dissolved in 200 parts by mass of xylene as to be high-molecular weight component/low-molecular weight component=30/70 in mass ratio, where these were heated and, under reflux, stirred and mixed for 12 hours. Thereafter, the organic solvent was evaporated off, and the resin obtained was cold-rolled to solidify, followed by pulverization to obtain R-3-H/L.

90 parts by mass of R-3-H/L and 10 parts by mass of the cross-linkable resin component R-3-C were put into Henschel mixer and mixed, and the mixture thus obtained was melt-mixed by means of a twin-screw extruder heated to 200° C., whereby carboxyl groups and glycidyl groups were allowed to react with each other to effect cross-linking. The resin thus obtained was cold-rolled to solidify, followed by pulverization to obtain a styrene-acrylic cross-linked resin, R-3.

The styrene-acrylic cross-linked resin R-3 thus obtained had, in its molecular weight distribution of tetrahydrofuran-soluble matter, a main peak at molecular weight of 15,900, a sub-peak at molecular weight of 339,000 and a weight average molecular weight (Mw) of 214,600, and contained 11% by mass of tetrahydrofuran-insoluble matter. It also had an acid value of 10.3 mgKOH/g, a glass transition temperature of 60° C. and a softening point of 107° C. It was also ascertained in addition, that the styrene-acrylic cross-linked resin R-3 obtained had a moiety of the following structural formula (A).

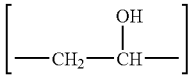

(A)

Binder Resin Production Example 4

The high-molecular weight component R-3-H and low-molecular weight component R-3-L obtained in Binder Resin Production Example 3 were so mixed and dissolved in 200 parts by mass of xylene as to be high-molecular weight component/low-molecular weight component=40/60 in mass ratio, where these were heated and, under reflux, stirred and mixed for 12 hours. Thereafter, the organic solvent was evaporated off, and the resin obtained was cold-rolled to solidify, followed by pulverization to obtain a styrene-acrylic resin, R-4, which was non-cross-linked.

The styrene-acrylic resin R-4 thus obtained had, in its molecular weight distribution of tetrahydrofuran-soluble matter, a main peak at molecular weight of 15,300, a sub-peak at molecular weight of 318,500 and a weight average molecular weight (Mw) of 344,100, and did not contain any tetrahydrofuran-insoluble matter. It also had an acid value of 12.7 mgKOH/g, a glass transition temperature of 59° C. and a softening point of 96° C.

Example 1

| | |
|---|---|
| Hybrid resin R-1 | 100 parts by mass |
| Wax 1 | 6 parts by mass |
| Fischer-Tropsch wax (melting point: 105° C.) | 2 parts by mass |
| Magnetite (number average particle diameter: 0.18 μm) | 100 parts by mass |
| Above azo type iron compound (1) (counter ion: $NH_4^+$) | 2 parts by mass |

The above materials were premixed using Henschel mixer. Thereafter, the mixture obtained was kneaded by means of a twin-screw extruder (PCM-30, manufactured by Ikegai Corp.) set at a temperature of 130° C. and a number of revolutions of 200 rpm. The melt-kneaded product obtained was cooled, and then the melt-kneaded product cooled was crushed by means of a cutter mill. Thereafter, the crushed product obtained was finely pulverized using Turbo Mill T-250 (manufactured by Turbo Kogyo Co., Ltd.), controlling air temperature so that the exhaust temperature came to be 45° C., followed by classification by means of a multi-division classifier utilizing the Coanda effect, to obtain Magnetic Toner Particles 1. This Magnetic Toner Particles 1 had a weight-average particle diameter (D4) of 5.9 μm, and had particles with particle diameter of 2.00 μm or more to 4.00 μm or less in number distribution, in a content of 22.3% by number.

Further, 100 parts by mass of this Magnetic Toner Particles 1 and 1.2 parts by mass of hydrophobic fine silica powder [obtained by surface-treating 100 parts by mass of dry-process silica (BET specific surface area: 200 $m^2/g$) with 10 parts by mass of hexamethyldisilazane and then treating 100 parts by mass of this treated silica with 10 parts by mass of dimethylsilicone oil] were mixed by means of Henschel mixer to prepare Toner 1.

This Toner 1 contained 22% by mass of tetrahydrofuran-insoluble matter. Tetrahydrofuran-soluble matter of the component separated by hydrolysis of this tetrahydrofuran-insoluble matter and then by filtration was analyzed to find that the residue (vinyl resin) had a main-peak molecular weight of 112,700 and a weight average molecular weight of 276,600. Also, its vinyl polymer unit contained in the tetrahydrofuran-insoluble matter was in a content of 47% by mass.

This toner was evaluated on the following items. The results of evaluation are shown in Table 2.

Fixing Test

An external fixing assembly was used which was so set up that a fixing assembly of a laser beam printer LASER JET 4350, manufactured by Hewlett-Packard Co., was taken out and was so made that the fixing temperature of its fixing unit was able to be set as desired and its process speed was 400 mm/second. This external fixing assembly was temperature-controlled within the temperature range of from 140° C. to 220° C. at intervals of temperature 5° C. from temperature 140° C., and developed solid-black unfixed toner images (set to be 0.6 mg/cm$^2$ in toner level on paper) were fixed to sheets of plain paper (75 g/m$^2$). Fixed images thus obtained were to and fro rubbed 5 times with Silbon paper under application of a load of 4.9 kPa, where the rate of density decrease in image density before and after the rubbing came to 10% or less was regarded as fixing temperature. The lower this temperature is, the better low-temperature fixing performance the toner has.

Unfixed toner images were also fixed at a process speed changed to 100 mm/second and at temperatures controlled within the temperature range of from 150° C. to 240° C. at intervals of temperature 5° C. from temperature 150° C. Any stain on fixed images that was due to a high-temperature offset phenomenon was visually examined, where the temperature at which it came about was regarded as high-temperature offsetting temperature. The higher this temperature is, the better high-temperature anti-offsetting properties the toner has.

Developing Test

A commercially available laser beam printer LASER JET 4350, manufactured by Hewlett-Packard Co., was converted to a 65-sheet machine, and image reproduction was tested in environments of a normal-temperature and normal-humidity environment (23° C., 60% RH) and a high-temperature and high-humidity environment (32.5° C., 80% RH) and using A4-size 75 g/m$^2$ transfer sheets. As image data, original-image data of 1% in image area percentage were used. Under these conditions, solid-black image density at the initial stage and that at the time of 30,000-sheet paper feeding were measured. In regard to the normal-temperature and normal-humidity environment, fog was measured.

To measure the image density, reflection density was measured with MACBETH Densitometer (manufactured by Gretag Macbeth Ag.) using an SPI filter, and was calculated as an average at 5 spots.

As the measurement of fog, the fog was calculated from a difference between the whiteness of a transfer sheet and the whiteness of the transfer sheet after the printing of solid white thereon which were measured with REFLECTOMETER (manufactured by Tokyo Denshoku Co., Ltd.).

Cleaning Blade Turn-Up

Using the conversion machine used in the above developing test, continuous double-side printing was tested in a high-temperature environment of temperature 35° C. and using A4-size 75 g/m$^2$ transfer sheets, where cleaning blade turn-up was examined to make evaluation according to the following criteria.

A: Any cleaning blade turn-up does not occur.
B: Cleaning blade turn-up occurs in printing on 10,000 sheets or more.
C: Cleaning blade turn-up occurs in printing on 5,000 sheets or more to less than 10,000 sheets.
D: Cleaning blade turn-up occurs in printing on 1,000 sheets or more to less than 5,000 sheets.
E: Cleaning blade turn-up occurs in printing on less than 1,000 sheets.

Blocking Test 10 g of the toner was weighed out in a cylindrical polypropylene cup of 3 cm in diameter, and its surface was leveled. Thereafter, powdered-medicine wrapping paper was spread thereon, and 10 g of an iron powder carrier was further placed thereon. These were left to stand at a temperature of 50° C. for 5 days, and then evaluation was made on the state of blocking of the toner.

A: The toner flows smoothly when the cup is inclined.
B: While the cup is turned, the toner surface begins to crumble little by little to become smooth powder.
C: The toner surface crumbles upon application of force from the outside while the cup is turned, and the toner begins to flow smoothly before long.
D: Blocking balls form. They crumble when poked with something sharp.
E: Blocking balls form. They can not easily crumble even when poked.

Photosensitive Member Toner Melt Sticking:

In a 30,000-sheet developing test in the high-temperature and high-humidity environment, whether or not the toner came to melt-stick onto the photosensitive member was examined visually and with a magnifier to make evaluation.

A: Any toner melt sticking is not seen at all.
B: Toner melt sticking of less than 0.1 mm in diameter is seen on the photosensitive member at one spot or more to less than five spots.
C: Toner melt sticking of less than 0.1 mm in diameter is seen on the photosensitive member at five spots or more to less than ten spots.
D: Toner melt sticking of 0.1 mm or more to less than 0.5 mm or more in diameter is seen on the photosensitive member at one spot or more to less than ten spots.
E: Toner melt sticking of 0.5 mm or more in diameter is seen on the photosensitive member at ten spots or more.

Example 2

Toner 2 was prepared in the same way as in Example 1 except that Wax 1 in Example 1 was changed for Wax 2. The results of evaluation are shown in Table 2.

Example 3

Toner 3 was prepared in the same way as in Example 1 except that Wax 1 in Example 1 was changed for Wax 3. The results of evaluation are shown in Table 2.

Example 4

Toner 4 was prepared in the same way as in Example 1 except that Wax 1 in Example 1 was changed for Wax 4. The results of evaluation are shown in Table 2.

Example 5

Toner 5 was prepared in the same way as in Example 1 except that Wax 1 in Example 1 was changed for Wax 5. The results of evaluation are shown in Table 2.

Example 6

Toner 6 was prepared in the same way as in Example 5 except that the hybrid resin R-1 in Example 5 was changed for the polyester resin R-2. The results of evaluation are shown in Table 2.

Example 7

Toner 7 was prepared in the same way as in Example 5 except that the hybrid resin R-1 in Example 5 was changed for the styrene-acrylic cross-linked resin R-3. The results of evaluation are shown in Table 2.

Example 8

Toner 8 was prepared in the same way as in Example 7 except that Wax 5 in Example 7 was changed for Wax 6. The results of evaluation are shown in Table 2.

Example 9

Toner 9 was prepared in the same way as in Example 7 except that Wax 5 in Example 7 was changed for Wax 7. The results of evaluation are shown in Table 2.

Comparative Example 1

Toner 10 was prepared in the same way as in Example 7 except that Wax 5 in Example 7 was changed for Wax-8. The results of evaluation are shown in Table 2.

Comparative Example 2

Toner 11 was prepared in the same way as in Comparative Example 1 except that the styrene-acrylic cross-linked resin R-3 in Comparative Example 1 was changed for the styrene-acrylic resin R-4, which was non-cross-linked. The results of evaluation are shown in Table 2.

Comparative Examples 3 to 5

Toners 12 to 14 were prepared in the same way as in Example 7 except that Wax 5 in Example 7 was changed for Waxes 9 to 11, respectively. The results of evaluation are shown in Table 2.

TABLE 2

| | Fixing performance | | Developing performance | | | | | | | | |
|---|---|---|---|---|---|---|---|---|---|---|---|
| | | | Normal temp./ normal humidity | | | | High temp./ high humidity | | | | Photo |
| | Low-temp. | High-temp. | Image density | | Fog | | Image density | | Anti- | Cleaning | sensitive |
| | fixing performance | offsetting temp. | Initial stage | 30,000 sheets | Initial stage | 30,000 sheets | Initial stage | 30,000 sheets | block-ing | blade turnup | member toner melt sticking |
| Example: | | | | | | | | | | | |
| 1 | 140° C. | 240° C.* | 1.52 | 1.51 | 0.1 | 0.2 | 1.51 | 1.48 | A | A | A |
| 2 | 140° C. | 240° C.* | 1.51 | 1.49 | 0.2 | 0.4 | 1.50 | 1.46 | A | A | A |
| 3 | 150° C. | 240° C. | 1.47 | 1.42 | 0.5 | 1.1 | 1.44 | 1.39 | B | B | B |
| 4 | 155° C. | 230° C. | 1.43 | 1.40 | 1.0 | 1.7 | 1.41 | 1.35 | B | B | B |
| 5 | 160° C. | 225° C. | 1.41 | 1.36 | 1.3 | 2.4 | 1.40 | 1.31 | B | C | B |
| 6 | 165° C. | 225° C. | 1.40 | 1.30 | 2.1 | 2.9 | 1.38 | 1.29 | C | C | B |
| 7 | 175° C. | 215° C. | 1.39 | 1.27 | 2.5 | 3.3 | 1.35 | 1.22 | D | C | C |
| 8 | 180° C. | 210° C. | 1.30 | 1.14 | 3.3 | 4.7 | 1.28 | 1.10 | D | C | D |
| 9 | 195° C. | 210° C. | 1.27 | 1.13 | 4.1 | 5.2 | 1.26 | 1.05 | D | D | E |
| Comparative Example: | | | | | | | | | | | |
| 1 | 200° C. | 205° C. | 1.14 | 1.02 | 4.8 | 6.9 | 1.03 | 0.94 | D | E | E |
| 2 | 200° C. | 180° C. | 1.04 | 0.91 | 6.6 | 8.2 | 0.95 | 0.72 | E | E | E |
| 3 | 150° C. | 230° C. | 1.11 | 0.98 | 5.1 | 7.7 | 0.95 | 0.80 | B | C | B |
| 4 | 160° C. | 225° C. | 1.25 | 1.03 | 4.5 | 5.6 | 1.20 | 0.99 | E | E | E |
| 5 | 215° C. | 230° C. | 1.26 | 1.11 | 4.3 | 5.5 | 1.24 | 1.01 | B | C | B |

*No offsetting.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions This application claims priority from Japanese Patent Application No. 2007-335930, filed Dec. 27, 2007, which is herein incorporated by its reference.

What is claimed is:

1. A toner comprising: a binder resin, a colorant and a wax, wherein the wax is an aliphatic hydrocarbon wax having been subjected to alcohol conversion and has a hydroxyl value from 5 mgKOH/g or more to 150 mgKOH/g or less, and wherein in the molecular weight distribution of the wax measured by gel permeation chromatography of tetrahydrofuran-soluble matter, a main peak is observed within the range of molecular weight from 200 or more to 600 or less, and a component in the wax with a molecular weight of 700 or more is present in a content of 3% by mass or less.

2. The toner according to claim 1, wherein the wax has been purified with a solvent.

3. The toner according to claim 2, wherein the solvent is an alcohol or a ketone.

* * * * *